United States Patent [19]

Kato et al.

[11] 4,171,975

[45] Oct. 23, 1979

[54] LIGHT-SENSITIVE SILVER HALIDE COLOR PHOTOGRAPHIC MATERIALS

[75] Inventors: Kazuo Kato, Yokohama; Shizuo Saito, Hachioji; Hidenori Kawaguchi, Tachikawa, all of Japan

[73] Assignee: Konishiroku Photo Industry Co., Ltd., Tokyo, Japan

[21] Appl. No.: 875,882

[22] Filed: Feb. 7, 1978

[30] Foreign Application Priority Data

Feb. 10, 1977 [JP] Japan ..... 52-13600

[51] Int. Cl.[2] ..... G03C 1/40; G03C 1/06

[52] U.S. Cl. ..... 96/100 R; 96/56; 96/56.5; 96/76 R; 96/95

[58] Field of Search ..... 96/100, 56, 56.5, 76 R, 96/95

[56] References Cited

U.S. PATENT DOCUMENTS

| | | | |
|---|---|---|---|
| 2,671,021 | 3/1954 | Kleiger et al. | 96/56.5 |
| 3,212,893 | 10/1965 | Salminen | 96/56 |
| 3,468,666 | 9/1969 | Shiba et al. | 96/100 |
| 3,888,680 | 6/1975 | Fujiwhara et al. | 96/100 |
| 3,930,866 | 1/1976 | Oishi et al. | 96/56 |

*Primary Examiner*—Travis Brown

*Attorney, Agent, or Firm*—Bierman & Bierman

[57] ABSTRACT

A silver halide emulsion containing an aldehydebis type magenta coupler and an amide compound.

14 Claims, No Drawings

LIGHT-SENSITIVE SILVER HALIDE COLOR PHOTOGRAPHIC MATERIALS

This invention relates to light-sensitive silver halide color photographic materials and particularly is concerned with light-sensitive silver halide color photographic materials having improved magenta color developability at the time of color development, high stability to photographic processing and improved preservability of images formed after the processings.

There has heretogone been widely known a process for the formation of a magenta color image by developing, with a color developing solution containing a p-phenylenediamine derivative, a light-sensitive color photographic material prepared by coating a support of said photographic material on the surface with a silver halide emulsion which has been incorporated according to various procedures with a magenta coupler.

It is generally well known that the silver halide emulsion used for the purpose referred to above is composed of a dispersion prepared by dispersing silver halide particles in a hydrophilic binder such as gelatin. For instance, C. E. K. Mees and T. H. James, "The Theory of the Photographic Process", IIIrd Ed. 31, Macmillan Co., N.Y. 1966 discloses an outline of such silver halide emulsion used for that purpose.

Known as magenta couplers having a pyrazolone or pyrazolonebenzimidazole structure are those which have been fully described in a treatise by P. W. Vitum and A. weissberger adt pages 81–96 of Journal of the photographic Science, Vol. 2, No. 3, May-June 1954, or in W. Pels, "Mitteinlungen aus den Forschunslaboratorien der Agfa III," 111, 1961.

In recent years, development of couplers quickly reactive with oxidation products of developing agents has been promoted with ever increasing demand in the field of light-sensitive silver halide color photographic materials high in photographic speed. Furthermore, there is a strong demand for the rapidity and stability of processing and to avoid water pollution by processing solutions, for example, there have heretofore been proposed various improvements such as the use in the bleaching step of complex salts of cations of polyvalent metals with organic acids in place of ferricyanide used heretofore as oxidizing agents in bleaching solutions, and development of couplers adaptable to such changes in the processing has been promoted, as well. Still further, there is a widely growing demand for improvement in preservability of images formed by processing and also for improvement in quality of image such as graininess and sharpness.

Various demands mentioned above can be met by the development of novel couplers having excellent efficiency as well as by the development of new technique of using the couplers. In the field of magenta couplers, however, a coupler capable of meeting sufficiently such demands has not been yet developed. That is, the so-called 2-equivalent coupler requiring only development of two moles of silver halide for forming one mole of dye, which coupler is excellent in color developing efficiency and gives a high maximum density, however, has such drawbacks that the degree of sensitization is not sufficient, unnecessary formation of fog tends to occur and preservability of the image formed thereby is poor. Furthermore, the so-called bis type magenta coupler having in the molecule two pyrazolone or pyrazolonebenzimidazole nuclei is quick in reactivity with an oxidation product of developing agent, and so is effective for the sensitization purposes. When this coupler is used according to the prior art method of use thereof, however, color developability is poor and processing stability is low, and such defects are observed particularly markedly in a color development processing step involving a bleaching treatment step with low oxidizing ability, which bleaching treatment step has come to have low oxidizing ability with the view of freeing the treatment from pollution, and also preservability of the image formed by development is poor.

Accordingly, a primary object of the present invention is to provide high-speed light-sensitive silver halide color photographic materials containing magenta coupler.

A second object of the present invention is to provide light-sensitive silver halide color photographic materials excellent in processing stability.

A third object of the present invention is to provide light-sensitive silver halide color photographic materials excellent in image preservability.

Other objects of the present invention will become apparent from the following description.

As the result of extensive studies and investigations, it has been found that the abovementioned objects can be accomplished by incorporation into a light-sensitive silver halide color photographic material of an aldehydebis type magenta coupler and a compound represented by the following general formula [I].

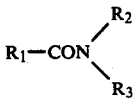

General formula (I)

wherein $R_1$, $R_2$ and $R_3$ individually represent hydrogen, an apliphatic hydrocarbon residue or an aryl group, provided that at least one of $R_1$, $R_2$ and $R_3$ contains not less than six carbon atoms and $R_1$ and $R_2$, or $R_3$ and $R_3$ may combine together to form a 5- to 7-membered heterocyclic ring containing nitogen.

That is, it has been discovered that such an effect as could not be anticipated at all by the conventional common knowledge is brought about to sufficiently meet the above-mentioned objects when a light-sensitive silver halide color photographic material is incorporated with an amide compound represented by the general formula [I] having many deffects that when it is used as a high boiling-point organic solvent in preparing a dispersion of a 2-equivalent or 4-equivalent coupler, the formation of fog is remarkably high and the coupler dispersion prepared thereby is poor in stability; and an aldehydebis type magenta coupler having many defects as mentioned above when used in combination with such high boiling-point organic solvent as tricresyl phosphate, di-n-butyl phthalate or dioctyl phthalate which has heretofore been used as a high boiling-point organic solvent in preparing a dispersion of a 2-equivalent or 4-equivalent coupler.

By aldehydebis type coupler as used in the present invention is meant a magenta coupler which is obtained by condensing a 5-pyrazolone compound and/or pyrazolino-[1,5-a]-benzimidazole compound with an aldehyde compound, whereupon the resulting condensate comes to have a bis-form by means of methylene or methine groups formed from the aldehyde group. The aldehydebis type magenta couplers used in the present invention covers the compounds represented by the following general formula [II].

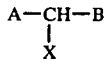

General formula (II)

wherein A- and B- individually represent a 5-pyrazolone coupler residue represented by the following general formula [III] or a pyrazolino-[1,5-a]-benzimidazole coupler residue represented by the following general formula [IV] and A- and B- may be the same or different.

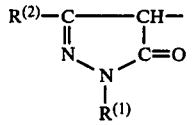

General formula (III)

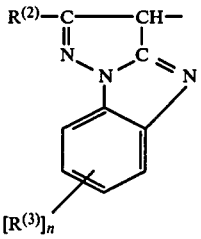

General formula (IV)

wherein $R^{(1)}$ represents hydrogen or a straight chain or a branched chain alkyl group of 1 to 35 carbon atoms, preferably 1 to 22 carbon atoms (e.g. methyl, isopropyl, tert-butyl, hexyl, dodecyl, pentadecyl, etc.); an alkenyl group (e.g. allyl, etc.); a cycloalkyl group (e.g. cyclopentyl, cyclohexyl, norbonyl, etc.); or a cycloalkenyl group (e.g. cyclopentinyl, cyclohexenyl, etc.). Further, $R^{(1)}$ may represent an aryl group (e.g. phenyl, α- or β-naphthyl, etc.). Preferably $R^{(1)}$ represents phenyl substituted at least at one of the ortho-position with alkyl, alkoxy or halogen, which phenyl is useful since the formation of yellow stain by the coupler remaining in the film due to light or heat is low. More preferably, particularly useful is phenyl substituted, at the 2-, 4- and 6-positions, by alkyl, alkoxy and/or halogen, or in which the all of the 2-, 3-, 4-, 5- and 6-positions of the phenyl have been substituted by halogen, alkyl and/or alkoxy, since the formation of yellow stain by the coupler remaining in the film due to light or heat is more low and preservability of the color developed dye is favorable.

Further, $R^{(1)}$ may preferably represent a heterocyclic ring (e.g. 5- or 6-membered heterocyclic or condensed heterocyclic rings containing nitrogen, oxygen or sulfur as heteroatom, such as pyridyl, quinolyl, furyl, benzothiazolyl, oxazolyl, imidazolyl, naphthoxazolyl, etc.).

Still further, $R^{(1)}$ may represent an acyl group, a thioacyl group, an alkylsulfonyl group, an arylfulfonyl group, an alkylsulfinyl group, an aryl sulfinyl group, a carbamoyl group or a thiocarbamoyl group.

In the above-mentioned formulas, $R^{(2)}$ represents a straight chain or branched chain alkyl group of 1 to 35, preferably 1 to 22 carbon atoms, an alkenyl group, a cycloalkyl group, an aralkyl group or a cycloalkenyl group.

Further, $R^{(2)}$ represents an aryl group or a heterocyclic ring.

Furthermore, $R^{(2)}$ represents an alkoxycarbonyl group (e.g. methoxycarbonyl, ethoxycarbonyl, stearyloxycarbonyl, etc.), an aryloxycarbonyl group (e.g. phenoxycarbonyl, α- or β-naphthoxycarbonyl, etc.), an aralkylcarbonyl group (e.g. benzyloxycarbonyl, etc.), an alkoxy group (e.g. methoxy, ethoxy, decyloxy, etc.), an aryloxy group (e.g. phenoxy, tolyloxy, etc.), an alkylthio group (e.g. ethylthio, dodecylthio, etc.), an arylthio group (e.g. phenylthio, naphthylthio, etc.), a carboxy group, an acylamino group (e.g. acetamido, tetradecaneamido, 2,4-di-tert-acylphenoxyacetamido, 3-{(2,4-di-tert-aminophenoxy)-acetamido}-benzamido, 3-{α-(3-pentadecylphenoxy)-butylamido}-benzamido, 3-(dodecylsuccinimido)-benzamido, 3-{α-(2,4-di-tert-amylphenoxy)-butylamido}-benzamido, etc.), a diacylamino group, an N-alkylacylamino group (e.g. N-methylpropionamido, etc.), an N-arylacylamido group (e.g. ureido, N-arylureido, N-alkylureido, etc.), an ureido group e.g. ureido, N-arylureido, N-alkylureido, N-arylthioureido, N-alkylthioureido, etc.), an urethane group, a thiourethan group, an anilino group (e.g. phenylamino, N-alkylanilino, N-arylanilino, N-acylanilino, 2-chloro-5-tetradecaneamidoanilino, 2,4-dichloroanilino, 2,5-dichloro-4-methoxyanilino, 2-methoxy-5-dodecylsulfamoylanilino, 2-chloro-5-dodecylsuccinimidoanilino, 2-chloro-5-octadecenylsuccinimidoanilino, 2-chloro-5-{γ-(2,4-di-tert-acylphenoxy)-butylamido}-anilino, etc.), an alkyl amino group (e.g. n-butylamino, N,N-dialkylamino, cycloalkylamino, etc.), a cycloamino group (e.g. piperidino, purrolidino, etc.), an alkylcarbonyl group (e.g. phenylcarbonyl, etc.), a sulfonamido group (alkylsulfonamido, arylsulfonamido, etc.), a carbamoyl group (e.g. N-alkylcarbamoyl, N,N-dialkylcarbamoyl, carbamoyl, N-alkyl-N-arylcarbamoyl, N-arylcarbamoyl, N,N-diarylcarbamoyl, etc.), a sulfamoyl group (e.g. N-alkylsulfamoyl, N,N-dialkylsulfamoyl, N-arylsulfamoyl, N-alkyl-N-arylsulfamoyl, N,N-diarylsulfamoyl, etc.), a guanidino group (e.g. N-alkylguanidino, N-arylguanidino, etc.), a cyano group, an acyloxy group (e.g. palmatoyloxy, etc.), a sulfonyloxy group (e.g. benzenesulfonyloxy, etc.), hydroxy, mercapto, halogen or sulfo.

In the above-mentioned formulas, $R^{(3)}$ represents hydrogen or a straight chain or branched chain alkyl group of 1 to 33, preferably 1 to 22 carbon atoms, an alkenyl group, a cycloalkyl group, an aralkyl group or a cycloalkenyl group.

Furthermore, $R^{(3)}$ represents an aryl group or a heterocyclic ring. Also, $R^{(3)}$ represents cyano, an alkoxy group, an aryloxy group, halogen, carboxy, an alkoxycarbonyl group, an acyloxy group, an alkylcarbonyl group, an arylcarbonyl group, an alkylthiocarbonyl group, an arylthiocarbonyl group, sulfo, a sulfamoyl group, a carbamoyl group, an acylamino group, a diacylamino group, an imido group, an ureido group, a thioureido group, an urethane group, a thiourethane group, a sulfonamido group, an alkylsulfonyloxy group, an arylsulfonyloxy group, an arylsulfonyl group, an alkylsulfonyl group, an arylthio group, an alkylthio group, an alkylsulfinyl group, an arylsulfinyl group, an alkylamino group a dialkylamino group, an anilino group, an N-arylanilino group, an N-alkylanilino group, an N-acylanilino group, hydroxy or mercapto and n represents an integer of 1–4.

In general formula [II], X represents hydrogen or a straight chain or branched chain alkyl group of 1 to 33, preferably 1 to 22 carbon atoms (e.g. methyl, ethyl, isopropyl, tert-butyl, hexyl, dodecyl, hexadecyl, etc.), an alkenyl group (e.g. aryl, 2-butenyl, styryl, 4-dimethylaminostyryl, etc.), an aralkyl group (e.g. benzyl, phenetyl, 4-chlorobenzyl, 4-methoxybenzyl, 3-methylbenzyl, 2-chlorobenzyl, etc.), a cycloalkyl group (e.g. cyclopentyl, cyclohexyl, norbonyl, etc.), or a cycloalkenyl group (e.g. cyclopentenyl, cyclohexenyl, etc.). Further, X represents an aryl group (e.g. phenyl, naphthyl, etc.).

Further, X represents a heterocyclic ring (e.g. a 5- or 6-membered heterocyclic group or a condensed heterocyclic group containing nitrogen, oxygen and/or sulfur as a hetero atom; such as pyridyl, quinolyl, furyl, benzylthiazolyl, oxazolyl, imidazolyl, etc.). In a preferred aspect of the light-sensitive color phtographic materials of the present invention, the aldehydebis type magenta coupler is incorporated into a silver halide emulsion layer, and the couplers to be incorporated into emulsion layers are required to be rendered non-diffusible. In order to render the coupler non-diffusible, the so-called ballast group containing a hydrophobic residue having at least 5, preferably from 8 to 32 carbon atoms is introduced into one molecule, or the molecular weight, per se, of the coupler is increased. The ballast group may be connected to the coupler skeletal structure either directly or through imino, ether, carbonamide, sulfonamide, imide, carbamoyl, sulfamoyl or the like bond. The bis-type magenta couplers used in the present invention represented by the term aldehydebis type magenta couplers may be made non-diffusible, even in the absence of the ballast group, by increasing the molecular weight of the coupler, per se.

Examples of aldehydebis type magenta coupler used in the present invention are given below. Exemplified compounds:

B-1. 4,4'-Methylenebis-{1-(2,4,6-trichlorophenyl)-3-heptadecyl-5-pyrazolone}

B-2. 4,4'-Benzylidenebis-[1-(2,6-dichloro-4-methoxyphenyl)-3-{4-(2,4-di-tert-amylphenoxyacetamido)-phenyl}-5-pyrazolone]

B-3. 4,4'-α-Propylmethylenebis-{1-(2,5-dichlorophenyl)-3-dodecylcarbamoyl-5-pyrazolone}

B-4. 4,4'-(4-Chlorobenzylidene)bis-[[1-[4-{α-(2,4-di-tert-amylphenoxy)-butylamido-phenyl}-3-ethoxy-5-pyrazolone]]

B-5. 4,4'-(4-Ethoxycarbonylbenzyliden)bis-(1-β,β,β-trifluoroethyl-3-hexadecaneamido-5-pyrazolone)

B-6. 4,4'-Benzylidenebis-{1-(2-benzothiazolyl)-3-heptadecyl-5-pyrazolone}

B-7. 4,4'-Methylenebis-{1-(4-ethoxycarbonylphenyl)-3-(2,4-di-tert-amylphenoxyacetamido)-5-pyrazolone}

B-8. 4,4'-Methylenebis-{1-(2,4-dimethyl-6-chlorophenyl)-3-(2,4-di-tert-amylphenoxyacetamido)-5-pyrazolone}

B-9. 4,4'-Methylenebis-{1-(2,4,6-trichlorophenyl)-3-hexadecaneamido-5-pyrazolone}

B-10. 4,4'-Methylenebis-[1-(2,4,6-trichlorophenyl)-3-{3-(2,4-di-tert-amylphenoxyacetamido)-benzamido}-5-pyrazolone]

B-11. 4,4'-Methylenebis-[[1-(2,4,6-trichlorophenyl)-3-[3-{α-(2,4-di-tert-amylphenoxy)-butylamido}-benzamido]-5-pyrazolone]]

B-12. 4,4'-Methylenebis-[[1-(2,6-dichloro-4-methoxyphenyl)-3-[3-{α-(2,4-di-tert-amylphenoxy)-butylamido}-benzamido]-5-pyrazolone]]

B-13. 4,4'-Methylenebis-[[1-(2,4-dimethyl-6-chlorophenyl)-3-[3-{α-(2,4-di-tert-amylphenoxy)-butylamido}-benzamido]-5-pyrazolone]]

B-14. 4,4'-Methylenebis-[[1-(2,4-dimethyl-6-chlorophenyl)-3-[3-{α-(3-n-pentadecylphenoxy)-butylamido}-benzamido]-5-pyrazolone]]

B-15. 4,4'-Methylenebis-{1-(2,4,6-trichlorophenyl)-3-(3-n-dodecylsuccinimido-benzamido)-5-pyrazolone}

B-16. 4,4'-Methylenebis-[[1-(2,4,6-trichlorophenyl)-3-[3-{γ-(n-propyloxy)-butylamido}-benzamido]-5-pyrazolone]]

B-17. 4,4'-Methylenebis-[1-(2,3,4,5,6-pentachlorophenyl)-3-{3-(2,4-di-tert-amylphenoxyacetamido)-benzamido}-5-pyrazolone]

B-18. 4,4'-Methylenebis-{1-(2,3,4,5,6-pentachlorophenyl)-3-(2,4-di-tert-amylphenoxyacetamido)-5-pyrazolone}

B-19. 4,4'-Methylenebis-[[1-(2,4,6-trichlorophenyl)-3-[3-{α-(3-tert-butyl-4-hydroxyphenoxy)-tetradecaneamido}-benzamido]-5-pyrazolone]]

B-20. 4,4'-(3-Methoxy-4-ethoxy-benzylidene)bis-[1-(2,4,6-trichlorophenyl)-3-{3-(2,4-di-tert-amylphenoxyacetamido)-benzamido}-5-pyrazolone]

B-21. 4,4'-Benzylidenebis-[[1-(2,4-dimethyl-6-chlorophenyl)-3-[3-{α-(2,4-di-tert-amylphenoxy)-butylamido}-benzamido]-5-pyrazolone]]

B-22. 4,4'-(2-Chlorobenzylidene)bis-[1-(2,4,6-trichlorophenyl)-3-{3-(2,4-di-tert-amylphenoxyacetamido)-benzamido}-5-pyrazolone]

B-23. 4,4'-(2-Chlorobenzylidene)bis-[[1-(2,4,6-trichlorophenyl)-3-[3-{α-(2,4-di-tert-amylphenoxy)-butylamido}-benzamido]-5-pyrazolone]]

B-24. 4,4'-(2,4-Dichlorobenzylidene)bis-[[1-(2,4,6-trichlorophenyl)-3-[3-{α-(2,4-di-tert-amylphenoxy)-butylamido}-benzamido]-5-pyrazolone]]

B-25. 4,4'-Methylenebis-[[1-(2,6-dichloro-4-methoxyphenyl)-3-[3-{α-(2,4-di-tert-amylphenoxy)-butylamido}-phenylureido]-5-pyrazolone]]

B-26. 4,4'-α-n-Pentylmethylenebis-[1-(2,6-dichloro-4-methoxyphenyl)-3-pentadecylureido-5-pyrazolone]

B-27. 4,4'-α-(4-Pyridyl)-methylenebis-1-(2,4,6-trichlorophenyl)-3-(2,4-di-tert-amylphenoxyacetamido)-5-pyrazolone B-28. 4,4'-α-(3-Pyridyl)-methylenebis-[1-(2,4,6-trichlorophenyl)-3-{3-(2,4-di-tert-amylphenoxyacetamido)-benzamido}-5-pyrazolone]

B-29. 4,4'-α-(2-Furyl)-methylenebis-[1-{4-(4-tert-butylphenoxy)phenyl}-3-octadecaneamido-5-pyrazolone]

B-30. 4,4'-α-Cyclohexyl-methylenebis-{1-(2,3,4,5,6-pentachlorophenyl)-3-hexadecaneamido-5-pyrazolone}

B-31. 4,4'-α-(2,6-Dimethyl-5-heptenyl)methylenebis-{1-(2,4,6-trichlorophenyl)-3-pivaloylamido-5-pyrazolone}

B-32. 4,4'-Methylenebis-{1-(2-chlorophenyl)-3-(2-chloro-4-tetradecaneamidoanilino)-5-pyrazolone}

B-33. 4,4'-Methylenebis-{1-(2,4,6-trichlorophenyl)-3-(2-chloro-4-dodecyloxy-anilino)-5-pyrazolone}

B-34. 4,4'-α-n-Propyl-methylenebis-{1-(2,5-dichlorophenyl)-3-(2-trifluoromethylanilino)-5-pyrazolone}

B-35. 4,4'-Benzylidenebis-{1-(2,4-dimethyl-6-chlorophenyl)-3-(2-chloro-4-dodecylsuccinimidoanilino)-5-pyrazolone}

B-36. 4,4'-Benzylidenebis-{1-(2,4,6-trichlorophenyl)-3-(2-methoxy-5-n-octadecenylsuccinimidoanilino)-5-pyrazolone}

B-37. 4,4'-Benzylidenebis-[[1-(2,4,6-trichlorophenyl)-3-[2-chloro-5-{γ-(2,4-di-tert-amylphenoxy)-butylamido}-anilino]-5-pyrazolone]]

B-38. 4,4'-Benzylidenebis-[1-(2,4,6-trichlorophenyl)-3-(2-chloro-5-n-dodecylsuccinimidoanilino)-5-pyrazolone]

B-39. 4,4'-Benzylidenebis-{1-(2,4,6-trichlorophenyl)-3-(2-chloro-5-dodecylcarbamoylanilino)-5-pyrazolone}

B-40. 4,4'-Benzylidenebis-{1-(2,4,6-trichlorophenyl)-3-(2-chloro-5-N,N-dibutylcarbamoylanilino)-5-pyrazolone}

B-41. 4,4'-Benzylidenebis-{1-(2,5-dichlorophenyl)-3-(2-chloro-5-N-methyl-N-octadecylsulfamoylanilino)-5-pyrazolone}

B-42. 4,4'-Benzylidenebis-[[1-(2,4-dimethyl-6-chlorophenyl)-3-[2-chloro-5-{γ-(2,4-di-tert-amylphenoxy)-butylamido}-anilino]-5-pyrazolone]]

B-43. 4,4'-(2,4-Dichlorobenzylidene)bis-{1-(2,4,6-trichlorophenyl)-3-(2-chloro-5-n-octadecenylsuccinimidoanilino)-5-pyrazolone}

B-44. 4,4'-(4-Chlorobenzylidene)bis-1-(2,6-dichloro-4-methoxyphenyl)-3-(2-dodecylsuccinimidoanilino)-5-pyrazolone B-45. 4,4'-(2-Chlorobenzylidene)bis-{1-(2,4,6-trichlorophenyl)-3-(2-chloro-5-tetradecaneamidoanilino)-5-pyrazolone}

B-46. 4,4'-α-(4-Pyridyl)methylenebis-[1-(2,4,6-trichlorophenyl)-3-{2-chloro-5-(2,4-di-tert-amylphenoxyacetamido)-anilino}-5-pyrazolone]

B-47. 4,4'-α-Cyclohexylmethylenebis-{1-(2,4,6-trichlorophenyl)-3-(2,5-dichloro-4-dodecyloxyanilino)-5-pyrazolone}

B-48. 4,4'-(4-Methoxybenzylidene)bis-[1-(2,4,6-trichlorophenyl)-3-{2-chloro-5-(4-tetradecaneamidobenzenesulfonamido)-anilino}-5-pyrazolone]

B-49. 4,4'-(4-Methylbenzylidene)bis-{1-(2,4,6-trichlorophenyl)-3-(2-methoxy-5-tert-octylanilino)-5-pyrazolone}

B-50. 4,4'-(4-N,N-dimethylaminobenzylidene)bis-[1-{2,6-dichloro-4-(2,4-di-tert-amylphenoxyacetamido)-phenyl}-3-(2,4-dichloroanilino)-5-pyrazolone]

B-51. 4,4'-(3-chlorobenzylidene)bis-[[1-(2,3,4,5,6-pentachlorophenyl)-3-[2-chloro-5-{α-(3-pentadecyl phenoxy)-butylamido}-anilino]-5-pyrazolone]]

B-52. 4,4'-Benzylidenebis-[[1-(2,3,4,5,6-pentachlorophenyl)-3-[2-chloro-5-{γ-(2,4-di-tert-amylphenoxy)-butylamido}-anilino]-5-pyrazolone]]

B-53. 4,4'-Benzylidenebis-[[1-(2,3,4,5,6-pentachlorophenyl)-3-[2-chloro-5-{α-(2,4-di-tert-amylphenoxy)-butylamido}-anilino]-5-pyrazolone]]

B-54. 4,4'-Benzylidenebis-{1-(2,3,4,5,6-pentachlorophenyl)-3-(2-chloro-5-n-dodecylsuccinimidoanilino)-5-pyrazolone}

B-55. 4,4'-(4-Bromobenzylidene)bis-{1-(2,4,6-trichloro-3,5-difluorophenyl)-3-(2-chloro-5-difluorophenyl)-3-(2-chloro-5-tetradecaneamidoanilino)-5-pyrazolone}

B-56. 4,4'-(2-Chlorobenzylidene)bis-{1-(2,3,4,5,6-pentachlorophenyl)-3-(2-chloro-5-n-dodecylcarbamoylanilino)-5-pyrazolone}

B-57. 4,4'-(3-Methoxy-4-hydroxy-benzylidene)bis-[[1-(2,3,4,5,6-pentachlorophenyl)-3-[2-methoxy-5-{γ-(3,4-di-tert-amylphenoxy)-butylamido}-anilino]-5-pyrazolone]]

B-58. 4,4'-α-styrylmethylenebis-{1-(2,3,4,5,6-pentachlorophenyl)-3-(2-dodecyloxyanilino)-5-pyrazolone}

B-59. 4,4'-(4-Chlorobenzylidene)bis[[1-(2,3,4,5,6-pentachlorophenyl)-3-[2-chloro-5-{γ-(2,4-di-tert-amylphenoxy)-butylamido}-anilino]-5-pyrazolone]]

B-60. 4,4'-α-(2-Furyl)methylenebis-[[1-(2,3,4,5,6-pentachlorophenyl)-3-[(2-chloro-5-{γ-(2,4-di-tert-amylphenoxy)-butylamido}-anilino]-5-pyrazolone]]

B-61. 4,4'-Methylenebis-[[1-(2,3,4,5,6-pentachlorophenyl)-(2-chloro-5-n-dodecylsulfamoylanilino)-5-pyrazolone]]

B-62. 4,4'-α-n-Pentylmethylenebis-{1-(2,3,4,5,6-pentachlorophenyl)-3-hexadecaneamido-5-pyrazolone}

B-63. 4-[α-{1-(2,4,6-Trichlorophenyl)-3-heptadecyl-5-pyrazolo-4-il}-methyl]-1-(2,4,6-trichlorophenyl)-3-hexadecaneamido-5-pyrazolone B-64. 4-[α-{1-(2,4,6-Trichlorophenyl)-3-hexadecaneamido-5-pyrazolo-4-il}-benzyl]-1-(2,4,6-trichlorophenyl)-3-{3-(2,4-di-tert-amylphenoxyacetamido)-benzamido}-5-pyrazolone B-65. 4-[α-{1-(2,4,6-Trichlorophenyl)-3-(2-chloro-5-n-dodecylcarbamoylanilino)-5-pyrazolo-4-il}-benzyl]-1-(2,4,6-trichlorophenyl)-3-(2-chloro-5-tetradecaneamidoanilino)-5-pyrazolone B-66. 4-[α-{1-(2,4,6-Trichlorophenyl)-3-(2-chloro-5-tetradecaneamidoanilino)-5-pyrazolo-4-il}-benzyl]-1-(2,4-dimethyl-6-chlorophenyl)-3-(3-tetradecaneamidobenzamido)-5-pyrazolone B-67. 4-[α-{1-(2,4,6-Trichlorophenyl)-3-(2,5-di-chloro-4-methoxyanilini)-5-pyrazolo-4-il}-methyl]-1-(2,4,6-trichlorophenyl)-3-[3-{γ-(2,4-di-tert-amylphenoxy)-butylamido}-benzamido]-5-pyrazolone B-68. 4-[α-{1-(2,3,4,5,6-Pentachlorophenyl)-3-(2-dodecyloxyanilino)-5-pyrazolo-4-il}-benzyl]-1-(2,4,6-trichlorophenyl)-3-(2-chloro-5-dodecylsuccinimidoanilino)-5-pyrazolone B-69. 4-[α-{1-(2,3,4,5,6-Pentachlorophenyl)-3-(2,5-dichloroanilino)-5-pyrazolo-4-il}-3,7-dimethyl-6-octanyl)-1-(2,3,4,5,6-pentachlorophenyl)-3-(2,4-dichloroanilino)-5-pyrazolone B-70. 4,4'-(3-Methylbenzylidene)bis-{1-(2,4,6-trichlorophenyl)-3-(2-chloro-5-dodecyloxycarbonylmethylaminoanilino)-5-pyrazolone}

B-71. 4,4'-(2-Methylbenzylidene)bis-{1-(2,4-dichloro-6-methoxyphenyl)-3-(2-chloro-5-dodecyloxycarbonylanilino)-5-pyrazolone}

B-72. 4,4'-(3-Methoxy-4-ethoxy-benzylidene)bis-1-(2,6-dichloro-4-n-dodecyloxyphenyl)-3-(2,5-dichloroanilino)-5-pyrazolone B-73. 4,4'-Benzylidenebis-[1-(2,4,6-trichlorophenyl)-3-{2-chloro-5-(α,α,β,β,γ,γ,δ,δ-ootafluorovalerylamido)anilino}-5-pyrazolone]

B-74. 4,4'-Benzylidenebis-[[1-(2,6-dichloro-4-methoxyphenyl)-3-[N-methyl-N-{4-(4-tert-butylphenoxy)-phenyl}-ureido]-5-pyrazolone]]

B-75. 3,3'-Methylenebis-{2-heptadecyl-pyrazolino[1,5-a]benzimidazole}

B-76. 3,3'-Benzylidenebis-{2-heptadecyl-6-methoxypyrazolino[1,5-a]benzimidazole}

B-77. 3,3'-(2-Chlorobenzylidene)bis-[[2-[4-{α-2,4-di-(tert-amylphenoxy)-butylamido}-phenyl]-pyrazolino[1,5-a]benzimidazole]]

B-78. 3,3'-Methylenebis-{2-(2,4-di-tert-amylphenoxyacetamido)-6,8-dichloro-pyrazolino[1,5-a]benzimidazole}

B-79. 3-[α-{1-(2,4,6-Trichlorophenyl)-3-heptadecyl-5-pyrazolo-4-il}-methyl]-2-heptadecyl-pyrazolo[1,5-a]benzimidazole In addition to those particularly exemplified above, the aldehydebis type magenta coupler used in the present invention includes aldehydebis type magenta couplers disclosed, for example in U.S. Pat. Nos. 2,213,986, 2,294,909, 2,618,641, 2,706,683, 3,462,270 and 3,468,666; methylene bis type magenta couplers obtained by transforming the active point of a 5-pyrazolone magenta coupler with the aid of formaldehyde into a bis-type as disclosed in U.S. Pat. No. 3,888,680; aldehydebis type magenta couplers obtained by transforming 3-ureido-5-pyrazolone magenta couplers with the aid of aldehyde compounds into a bis-type as disclosed in U.S. Pat. No. 3,834,908; aldehydebis type magenta couplers obtained by transforming 3-anilino-5-pyrazolone magenta couplers with the aid of aldehyde compounds into a bis-type; and aldehydebis type magenta couplers obtained by the aid of arylaldehyde compounds having an auxochromous group at the p-position as disclosed in British Pat. Nos. 786,859 and 968,461. These couplers and the couplers exemplified previously may be synthesized according to procedures described in the above-mentioned patents or publications.

The aldehydebis type magenta couplers used in the present invention further include 4-equivalent 5-pyrazolone magenta couplers and 4-equivalent pyrazolino[1,5-a]benzimidazole magenta couplers as disclosed in U.S. Pat. Nos. 2,369,489, 2,439,909, 2,511,231, 2,600,788, 2,710,871, 2,933,391, 2,865,751, 3,062,653, 3,152,896, 3,519,429, 3,127,269, 3,061,432, 3,369,897, 3,393,071, 3,462,270, 3,567,449, 3,558,319, 3,677,764 and 3,684,514; magenta couplers having a substituted carbamoyl group in the anilino group of 3-anilino-5-pyrazolone magenta couplers as disclosed in British Pat. No. 1,399,306; magenta couplers having an

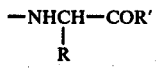

group in the anilino group of 3-anilino-5-pyrazolone magenta couplers; magenta couplers having a substituted sulfamoyl group in the anilino group of 3-anilino-5-pyrazolone magenta couplers as disclosed in U.S. Pat. No. 3,907,571; magenta couplers having a carboxylic ester group in the anilino group of 3-anilino-5-pyrazolone magenta couplers; magenta couplers having an aliphatic acylamino group in the 3-anilino group of 3-anilino-5-pyrazolone magenta couplers as disclosed in U.S. Pat. No. 3,935,015; magenta couplers having a fluoro-substituted acylamino group in one molecule of 5-pyrazolone magenta couplers and pyrazolino[1,5-a]benzimidazole magenta couplers; and aldehydebis type magenta couplers prepared by using 4-equivalent magenta couplers such as magenta coupler having in one molecule a thoether-substituted succinimido group, which 4-equivalent magenta couplers are subjected to synthesis proceses as disclosed in the aforesaid patents and publications relating to aldehydebis type magenta couplers.

Of the aldehydebis type magenta couplers represented by the general formula [II], more preferably couplers are those in which A- and B- in said general formula II are individually a coupler residue represented by the following general formulas, and in that case A- and B- may be the same or different.

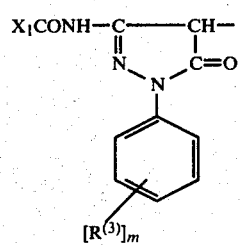

(III-a)

-continued

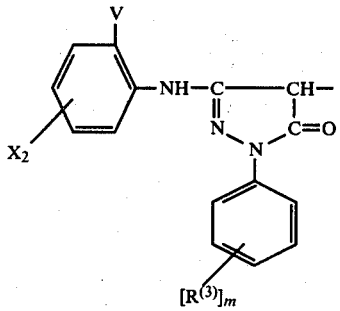

(III-b)

In the above-mentioned general formulas [III-a] and [III-b], $R^{(3)}$ is the same as $R^{(3)}$ in general formula IV.

V represents halogen (e.g. chlorine, bromine, fluorine, etc.), an alkoxy group (e.g. methoxy, ethoxy, butoxy, dodecyloxy, etc.), cyano, an aryloxy group, e.g. phenoxy, 4-tert-butylphenoxy, 3-chlorophenoxy, 4-chlorophenoxy, etc.), an alkylthio group (e.g. methylthio, ethylthio, dodecylthio, etc.), an arylthio group (e.g. phenylthio, 4-methylphenylthio, etc.), trifluoromethyl, nitro, an amido group (e.g. acetamido, tetradecaneamido, 2,4-di-tert-amylphenoxyacetamido, etc.), or an imido group (e.g. succinimido, dodecylsuccinimido, phthalimido, etc.).

$X_1$ represents a substituent of 1 to 30 carbon atoms, and a preferably substituent includes an alkyl group (e.g. dodecyl, tridecyl, pentadecyl, heptadecyl, heptadecenyl, (2,4-di-tert-amylphenoxy)-propyl, α-(2,4-di-tert-amylphenoxy)-propyl, α-(3-pentadecylphenoxy)-propyl, etc.), an aryl group (e.g. phenyl, 3-hexadecyl, amidophenyl, 3-[(2,4-di-tert-amylphenoxy)-acetamido]-phenyl, 3-[α-(2,4-di-tert-amylphenoxy)-butylamido-phenyl, 3-dodecylsuccinimido-phenyl, 3-[a-(3-pentadecylphenoxy)-butylamido]-phenyl, etc.), an arylamino group (e.g. 3-[α-(2,4-di-tert-amylphenoxy)-butyl amido]-phenylamino, etc.), and an alkylamino group (e.g. heptadecylamino, γ-(2,4-tert-amylphenoxy)-propylamino, etc.).

$X_2$ represents hydrogen or a substituent of 1 to 30 carbon atoms, and a preferable substituent includes an alkyl group (e.g. tert-octyl, pentadecyl, etc.), an alkoxy group (e.g. dodecyloxy, octadecyloxy, etc.), an aryloxy group (e.g. 4-tert-butylphenoxy, 3-pentadecylphenoxy, etc.), an acrylamino group (e.g. tetradecaneamido, α-(2,4-di-tert-amylphenoxy)-butylamido, γ-(2,4-di-tert-amylphenoxy)-butylamido, (3-dodecyloxyphenoxy)-acetamido, etc.), a carbamoyl group (e.g. dodecylcarbamoyl, N,N-dihexylcarbamoyl, γ-(2,4-di-tert-amylphenoxy)-propylcarbamoyl, etc.), a sulfamoyl group (e.g. dodecylsulfamoyl, N-ethyl-N-dodecylsulfamoyl, α-(2,4-di-tert-amylphenoxy)-propylsulfamoyl, etc.), a sulfonamido group (e.g. tetradecansulfonamido, benzenesulfonamido, etc.), an imido group (e.g. dodecylsuccinimido, octadecenylsuccinimido, etc.), an alkoxycarbonyl group (e.g. tetradecyloxycarbonyl, 2,4-di-tert-amylphenoxycarbonyl, etc.), and halogen, $X_2$ is a substituent at the m- or p-position, and m represents an integer of 1–5.

Of the representative compounds concretely exemplified previously, those as may be included in the more preferably aldehydebis type magenta couplers in accordance with the present invention are the exemplified compounds B-7 through B-62 and B-64 through B-74 but are not limited only thereto.

Of the aldehydebis type magenta couplers represented by general formula II, most preferred couplers are those in which A- and B- in general formula II are couplers residues of general formula III-a and further X is hydrogen, i.e. the couplers represented by the following general formula [V].

General formula (V)

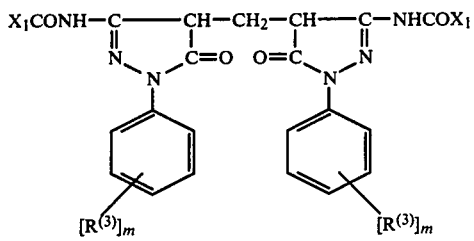

In the above formula, $X_1$, $R^{(3)}$ and m individually have the same meaning as defined previously. The most preferred couplers of this kind include, but not limitative, the aforesaid exemplified compounds B-7 through B-19 and B-25.

The groups, rings and residues appeared in all the general formulas include the substituted as explained before. Although the substituents may be any substituents, prefered ones are one or more appropriately selected from the group consisting of halogen, nitro, cyano, sulfo, hydroxy, carboxy, an alkyl group, an alkenyl group, an amino group, an alkoxy group, an alkenyloxy group, an alkylthio group, an alkenylthio group, an aryl group, an aryloxy group, an arylthio group, an acyl group, an acyloxy group, an acylamino group, a carbamoyl group, a sulfonamido group, a sulfamoyl group, an alkoxycarbonyl group, an aryloxycarbonyl group, an alkenyloxycarbonyl group, a cycloalkyl group, a cycloalkenyl group and a heterocyclic ring.

The compounds represented by the general formula [I] are explained more fully hereinafter.

In general formula I, $R_1$, $R_2$ and $R_3$ individually represent hydrogen, an aliphatic hydro carbon residue or an aryl group. However, the prominent effect of the present invention cannot be displayed unless at least one of the $R_1$, $R_2$ and $R_3$ has not less than six carbon atoms.

By an aliphatic hydrocarbon residue for $R_1$, $R_2$ and/or $R_3$ as used herein is meant an alkyl group, an alkenyl group or an alkynyl group. Preferable aliphatic hydrocarbon residues in the present invention include, for example, such groups having 1 to 20 carbon atoms as straight chain or branched alkyl; straight chain or branched alkenyl; halogen-substituted alkyl; alkoxyalkyl, alkoxyalkoxyalkyl; aryloxyalkyl; alkylcarbonyloxyalkyl; arylcarbonyloxyalkyl; alkylaryloxyalkyl and the like.

The aryl group represented by $R_1$, $R_2$ and/or $R_3$ is preferably phenyl or $\alpha$- or $\beta$-naphthyl (particularly preferably phenyl), which may have a substituent or substituents, the preferable substituent is selected from straight or branched alkyl of 1 to 15 carbon atoms, halogen, alkoxy of 1 to 15 carbon atoms, amino substituted with 1 or 2 alkyl groups and amino (a sum of carbon numbers being less than 15).

Further, $R_1$ and $R_2$ may co-operatively form, in cooperation with $$-\overset{\overset{R_3}{|}}{C}ON-,$$

a 5- to 7-membered heterocyclic ring. The heterocyclic ring is preferably a 2-pyrrolidinone ring and a 2-piperidinone ring (particularly preferably a pyrrolidinone ring). Preferably a heterocyclic ring is a heterocyclic nucleus which may be substituted with alkyl, alkylcarbonyloxy and/or alkyloxycarbonyl groups (these groups having 1 to 5 carbon atoms). When $R_1$ and $R_2$ are co-operatively form a heterocyclic ring, $R_3$ is preferably the aforesaid alkyl group of 8 to 20 carbon atoms. In the case, however, an alkyl group includes alkyl of 1 to 10 carbon atoms substituted with a residue (preferably a 2-pyrrolidinonyl group) of the 5- to 7-membered heterocyclic ring formed by $R_1$ and $R_2$, in cooperation with $$-\overset{\overset{R_3}{|}}{C}ON-.$$

Still further, $R_2$ and $R_3$ may co-operatively form, in cooperation with $B_1$—CON<, a 5- to 7-membered heterocyclic ring. The heterocyclic ring is preferably a piperidine ring, a morpholine ring, a piperadine ring and an imidazoline ring (particularly the former three rings are preferable).

Typical examples of the amide compound represented by the aforementioned general formula [I] are given below, but those exemplified should be construed as illustrative and not limitative.

A-1. N,N-Diethylhexaneamide
A-2. N-Butyloctaneamide
A-3. N,N-Dibutyloctaneamide
A-4. N-Ethyldodecaneamide
A-5. N,N-Diethyldodecaneamide
A-6. N,N-Diethyloleylamide
A-7. N,N-Dimethyltetradecaneamide
A-8. N,N-Dihexylbutaneamide
A-9. N-Decyl-N-methyl-octaneamide
A-10. N,N-Dibutylbenzamide
A-11. N,N-Diethyl-p-t-butylbenzamide
A-12. N,N-Dimethyl-o-chlorobenzamide
A-13. N,N-Diethyl-2-(2,4-di-t-pentylphenoxy) butaneamide
A-14. N,N-Dimethyl-p-nonylphenoxyacetamide
A-15. N,N-Dimethyl-p-nonylphenoxyacetamide
A-16. N-Decanoylpiperidine
A-17. N-Dodecanoylpyrrolidine
A-18. N-Octanoylmorpholine
A-19. N-Methyl-N-phenyloctaneamide
A-20. N-Ethyl-N-phenylheptaneamide
A-21. N-Ethyl-N-octyl-$\beta$-bromopropaneamide
A-22. N,N-Diethyl-3,6-dioxatetradecaneamide
A-23. N-Hexyl-2-pyrrolidinone
A-24. N-Dodecyl-2-pyrrolidinone
A-25. N-Tetradecyl-2-pyrrolidinone
A-26. N-Decyl-2-piperidinone
A-27. N-$\beta$-Hexanoyloxyethyl-2-pyrrolidinone
A-28. N,N'-Hexamethylene-bis-(2-pyrrolidinone)
A-29. N-Dodecyl-5-methyl-2-pyrrolidinone
A-30. N-Octyl-5-butanoyloxy-2-pyrrolidinone The compounds represented by the aforesaid general formula [I] may be synthesized according to a process similar to various procedures described in the prior art literatures. The compounds may be prepared, for example, by reaction of a carboxylic anhydride with a compound having an amino group; or using a condensation reaction by dehydrohalogenation of carboxylic halide with a compound having an amino group; an exchange reaction of a lower alcohol ester of a carboxylic acid with a compound having an amino group; a reaction under pressure of γ-butyrolactone with a compound having an amino group; and a desalting reaction of metal salt of lactam with alkyl halide. The compounds may be procured from commercially available products such as N,N-diethyldodecaneamide (produced by Eastman Kodak Co.)

Representatives of the amide compound exemplified above are concretely illustrated below with reference to a synthesis example.

SYNTHESIS EXAMPLE

Preparation of Compound A-25

A mixture of 86 g of γ-butyrolactone and 213 g of tetradecylamine is subjected to agitation in an autoclave at 280° C. for 6 hours. The reaction product thus obtained is taken out from the autoclave and, after removing low boiling fractions, is subjected to distillation under reduced pressure to obtain 235 g of the title compound, b.p. 185°-189° C./0.5 mm Hg.

Elementary analysis for $C_{16}H_{35}ON$. Found (%): C: 76.75; H: 12.57; N: 4.96.

Calculated (%): C: 76.80; H: 12.53; N: 4.98.

The aldehydebis type magenta couplers used in the present invention may be used either singly or in admixture of two or more. Further, the same or different aldehydebis type magenta couplers may be incorporated into two or more different silver halide emulsion layers. Into one of the silver halide emulsion layers of the photographic material, the coupler may be incorporated generally in a proportion of $1\times10^{-5}-5\times10^{-2}$ mole/m$^2$, preferably $1\times10^{-4}-1\times10^{-3}$ mole/m$^2$.

The amide compounds represented by the aforesaid general formula [I]used in the present invention may be used either singly or in admixture of two or more. Further, the same or different amide compounds may be incorporated into two or more different emulsion layer. The amount of the amide compound to be incorporated into the photographic material is appropriately 0.01 to 1000 times, preferably 0.1 to 100 times, the amount by weight of the aldehydebis type magenta coupler used in the present invention, which is present in said photographic material.

In incorporating the aldehydebis type magenta coupler and/or the amide compound of the aforesaid general formula [I], a dispersion of said coupler and/or said compound is prepared and then the dispersion may be incorporated into an emulsion for forming an emulsion layer, followed by drying.

The aldehydebis type magenta coupler used in the present invention may be dissolved in either a water-immiscible high boiling-point organic solvent having a boiling point higher than about 170° C. or a water-immiscible low boiling-point organic solvent, or a water-miscible organic solvent, or in a mixture comprising two or more of these solvents, and then the resulting solution may be formed into a dispersion according to such procedures as mentioned below.

Usable high boiling-point solvents are such organic solvents of high boiling points immiscible with water as disclosed in U.S. Pat. No. 2,322,072.

Particularly preferably solvents include dibutyl phthalate, dioctyl, phthalate, diisodecyl phthalate, triphenyl phosphate, tricresyl phthalate, benzyl phthalate, monophenyl-di-p-t-butylphenyl phosplate and dimethoxyethyl-phthalate.

Further, low boiling organic solvents or water-miscible organic solvent which are usable in combination with the high boiling-point solvent or in substitution for said high boiling-point solvent include such solvents as disclosed in U.S. Pat. Nos. 2,801,171 and 2,949,360. A low boiling-point organic solvent which is substantially immiscible with water may include, for example, ethyl acetate, propyl acetate, butyl acetate, butanol, chloroform, carbon tetrachloride, nitromethane, nitroethane and benzene. Water-miscible organic solvent may include, for example, acetone methylisobutyl ketone, β-ethoxyethyl acetate, methoxyglycol acetate, methanol, ethanol, acetonitrile, dioxane, dimethylformamide, dimethyl sulfoxide, hexamethyl sulfonamide, diethyleneglycol monophenyl ether and phenoxy ethanol.

The above-mentioned solvents may be used either singly or in combination of 2 or more.

The amide compound of the aforesaid general formula [I] may be dispersed either singly or after being dissolved in any one of the aforesaid high boiling-point organic solvents, low boiling-point organic solvent and water miscible organic solvent or in a mixture comprising a combination of two or more of these solvents.

The coupler and amide compound used in the present invention may be mixed together and then dispersed, or the mixture may be dissolved in any of the aforesaid high boiling-point organic solvent, low boiling-point or water-miscible organic solvent, or in a mixture comprising a combination of two or more of these solvents, and then dispersed.

In preparing a dispersion of a mixture of oil-soluble coupler and oil-soluble amide compound, or a mixture of coupler and amide compound, at least one of which is oil-soluble, the use of a homogenizer for emulsification, a colloid mill, a supersonic wave emulsifying apparatus or the like is of advantage.

Non-diffusionable coupler having in one molecule carboxylic acid group or sulfonic acid group together with a ballast group is soluble in neutral or weak alkaline aqueous solution, and the coupler may be incorporated into a silver halide emulsion by adding the aqueous solution of said coupler to said silver halide emulsion.

A part or whole of a water-immiscible high boiling-point organic solvent may be replaced by a polymer which is insoluble in water and soluble in an organic solvent.

In incorporating the coupler and amide compound into an emulsion, they may be used individually either in the form of an independent solution or independent dispersion, a solution or dispersion comprising a mixture of these independent solutions or independent dispersions may be incorporated into the emulsion, or a solution or dispersion comprising a mixture of the coupler and amide compound may be incorporated into the emulsion. Further, a solution or dispersion containing the coupler in admixture with the amide compound is mixed with a solution or dispersion of the coupler and/or a solution or dispersion of the amide compound and the resulting solution or dispersion may be incorporated into the emulsion.

In accordance with the present invention, it is preferably to incorporate both the coupler and amide compound used in the invention in the same one emulsion, whereupon the effect of the present invention is further enhance, and this is accomplished by employing any one of the aforesaid methode of incorporating into the emulsion of the coupler and amide compound.

When both the coupler and amide compound used in the present invention are incorporated into the same emulsion layer, the amount of coupler to be incorporated is generally $1\times10^{-4}$ to $5\times10^{-3}$ mole/m$^2$ (more preferably $3\times10^{-4}$ to $2\times10^{-3}$ mole/m$^2$), and that of the amide compound is preferably 0.01 to 10 times (more preferably 0.1 to 5 times) the amount by weight of the coupler incorporated into said emulsion layer. In that case, the coupler and amide compound used in the present invention are preferably present in the form of their respective oil drop, and both may be present either in the same oil drop or different oil drops. The oil drops may be incorporated with other oil-soluble photographic additives which will be mentioned later.

Of the modes of oil drops mentioned above, the most prefered is an oil drop containing both the coupler and amide compound. This oil drop may be attained by mixing an oil-soluble coupler with oil-soluble amide compound and dispersing the resulting mixture according to the aforesaid dispersing method using low boiling-point organic solvents. In that case, the aforesaid high boiling-point organic solvents may also be used in combination with the low boiling-point organic solvent. The amount of the high boiling-point organic solvent to be added to the oil drop is preferably such an amount that the total amount of said solvent an amide compound to be contained in said oil drop is 0.01 to 10 times (preferably 0.1 to 5 times) the amount by weight of the coupler contained therein. In the oil drop, the high boiling-point organic solvent is preferably present in an amount of 0 to 100 times (preferably 0 to 10 times) the amount by weight of the amide compound contained therein.

In order to exhibit the effect of the present invention more efficiently, it is effective to incorporate the light-sensitive silver halide color photographic material used in the invention with, in addition to the present aldehydebis type magenta coupler and amide compound of the general formula (I), a compound (hereinafter called "DIR compound") which release a development inhibiting type compound on reaction with an oxidation product of an aromatic primary amine developing agent. That is, it has been found that by the use of the DIR compound, color developability of the aldehydebis type magenta coupler in the color photographic processing involving a bleach processing step with lower oxidizing ability is further improved.

The above-mentioned DIR compounds are classified, according to the structure and function thereof, into two groups, one of the groups is the so-called DIR coupler which forms a colored dye on reaction with an oxidation product of the aromatic primary amine developing agent, and the other is the so-called DIR hydroquinone as well as DIR substance which forms a colorless compound.

Useful DIR couplers in the present invention include the compounds represented by the following general formulas (VI) and (VII):

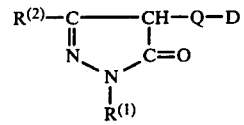

General formula (VI)

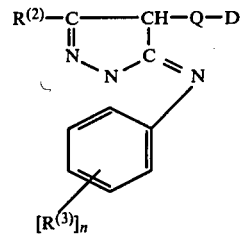

General formula (VII)

In the general formulas (VI) and (VII), $R^{(1)}$, $R^{(2)}$, $R^{(3)}$ and n individually have the same meanings as in the general formulas (III) and (IV).

Q in the general formulas (VI) and (VII) represents sulfur or selenium, and D represents a group, when the sulfur or selenium of the thioether bond or selenoether bond is liberated, forms together with said atom a compound having development inhibiting action, and the typical D includes an aryl group or a heterocyclic ring. For example, when Q is sulfur, a representative of the group in which said D and said sulfur are bonded together is a heterocyclic mercapto group, for example, a mercaptotetrazole group (particularly 1-phenyl-5-mercaptotetrazole, 1-nitrophenyl-5-mercaptotetrazole, 1-naphthyl-5-mercaptotetrazole, etc.), a mercaptothiazole group (particularly 2-mercaptobenzthiazole, mercaptonaphthothiazole, etc.), a mercaptooxadiazole group, a mercaptopyrimidine group a mercaptooxazole group, a mercaptotriazine group, a mercaptothiziazole group and a mercaptotriazole group, and an arylmercapto group, for example, a mercaptobenzene group (particularly 1-mercapto-2-benzoic acid, 1-mercapto-2-nitrobenzene, 1-mercapto-3-heptadecanoylaminobenzene, etc.).

When Q is selenium, a heterocyclic seleno group includes, for example, 1-phenyl-5-selenotetrazole, 2-selenobenzoxazole and 2-selenobenzthiazole, and an arylseleno group, for example, a selenobenzene group (e.g. 4-(4-hydroxyphenylsulfonyl)selenophenol, etc.).

Concrete examples of the DIR coupler used in the present invention are disclosed in British Pat. No. 953,454, U.S. Pat. Nos. 3,148,062, 3,227,554, 3,615,506, 3,701,783, 3,615,506 and 3,617,291, and processes for the synthesis thereof are also described therein.

Of the DIR couplers, those which display more preferable effect when used in the present invention are DIR couplers represented by the aforesaid general formula (VI). The DIR couplers of the general formula (VI), in which $R^{(1)}$ is a phenyl group, are further preferable. The substituent for phenyl of $R^{(1)}$ includes one or more halogen, lower alkyl, lower alkyloxy and alkylcarboxamido having a substituent (this substituent is preferably alkyl-substituted aryloxy). When the DIR compound of the general formula (VI), in which $R^{(1)}$ is the above-mentioned group and $R^{(2)}$ is a group mentioned below, is used, more preferable effect can be displayed. That is, when $R^{(1)}$ is phenyl substituted by halogen, lower alkyl and/or lower alkoxy, $R^{(2)}$ is preferably alkylcarboxamido having the above-mentioned substituent, and when $R^{(1)}$ is alkylcarboxamido having the above-mentioned substituent, $R^{(2)}$ is preferably a residue of nitrogen-containing 5- to 7-membered heterocyclic ring, such as 1-pyrrolidinyl group or 1-piperidinyl group.

The DIR hydroquinone used in the present invention includes the compounds represented by the following general formula (VIII). The DIR hydroquinone does not release a development inhibitor on coupling with the oxidation product of a developing agent as does the DIR coupler or DIR substance, but releases the development inhibitor on mutual oxidation with the oxidation product of a developing agent. The DIR hydroquinone, however, does not differ from the DIR coupler or DIR substance in that the reaction with the oxidation product of developing agent results in inhibition of development.

General formula (VIII)

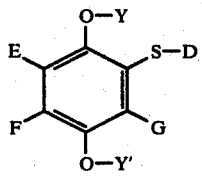

In the general formula (VIII), E, F and G individually represent hydrogen, an alkyl group (e.g. alkyl of 1 to 20 carbon atoms, such as methyl, ethyl, propyl, butyl, amyl, octyl, decyl, dodecyl, tridecyl, eicosyl, etc.), hydroxy, an alkoxy group (e.g. methoxy, ethoxy, butoxy, octyloxy, etc.), an amino group, an alkylthio group (e.g. nonylthio, tridecylthio, etc.), halogen, a heterocyclic ring (e.g. tetrazolyl, oxazolyl, imidazolyl, thiazolyl, quinolinyl, etc.) or —S—D (same as —S—D in the general formula (VIII)), and E and F may co-operatively form hydrocarbon ring, D represents the same group as in the case of Q in the general formulas [VI] and [VII] being sulfur, and Y and Y' are each preferably hydrogen, but may be individually a group capable of releasing under alkali conditions, for example, an acyl group, an alkoxycarbonyl group, an alkoxyoxalyl group, etc.

Concrete examples of the DIR hydroquinone are disclosed together with synthesis methods, for example, in U.S. Pat. Nos. 3,639,417, 3,379,529, 3,930,863 and 3,975,395.

The DIR substance is the DIR coupler in that the substance undergoes coupling reaction with the oxidation product of developing agent, but different from the DIR coupler in that the substance does not substantially form a dye image.

Useful DIR substance in the present invention includes the compounds represented by the following general formulas [IX], [X] and [XI]:

General formula (IX)

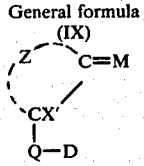

General formula (X)

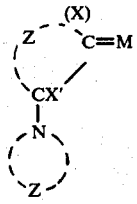

General formula (XI)

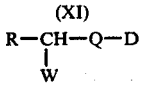

In the general formulas [IX], [X] and [XI], X' represents hydrogen or halogen, and Z represents a nonmetal atomic group necessary for forming a hydrocarbon ring or a heterocyclic ring. The hydrocarbon ring as for Z is, for example, a 5- to 7-membered saturated or unsaturated hydro carbon ring, and the typical examples thereof are cyclopentane, cyclohexane, cycloheptane, cyclopentene, cyclohexene, cycloheptene and cyclohexadiene. Typical condensed ring includes, for example, indane, benzcyclohexane and benzcycloheptane, and these hydro carbon rings may have one or more —Q—D or

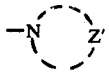

group at a position adjacent to the carbonyl.

The heterocyclic ring as for Z is, for example, a 5- to 7-membered ring containing nitrogen, oxygen and/or sulfur, and the typical examples thereof are such groups which form, together with the carbonyl, piperidone (e.g. 2-piperidone, 3-piperidone, 4-piperidone), lactone (e.g. a 4- to 7-membered ring), lactam (e.g. pyrrolidone), hydrantoin, indole (e.g. oxyindole) and the like. M represents oxygen or =N—L, in which L represents hydroxy or an amino group.

In the general formula [X], Z' represents atomic group which forms, when the C-N bond is cleaved, together with nitrogen, a heterocyclic ring having development inhibiting action, and Z' include such atomic groups as benztriazole (e.g. 5-methylbenztriazole, 5-bromobenztriazole, 5-octaderonamidobenztriazole, 5-benzyloxybenztriazole, etc.), naphthatriazole, indazole (e.g. 4-nitroindazole), pyrazole, thiohydrantoin and rhodanine.

Concrete examples of the compounds of the general formulas [IX] and [X] are disclosed, together with synthesis methods, for example in U.S. Pat. Nos. 3,958,993, 3,961,959, 3,938,996, 4,010,035 and 4,063,950.

In the general formula [XI], R represents

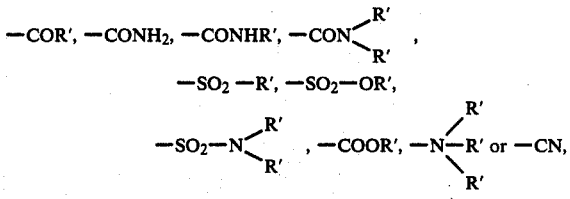

in which R' is (1) an alkyl group e.g. alkyl of 1 to 18 carbon atoms (preferably 1 to 5 carbon atoms) (e.g. methyl, ethyl, propyl, butyl, amyl, etc.), an alkenyl group (e.g. ethenyl, allyl, etc.), and (2) an aryl group, preferably a phenyl group or a naphthyl group, and (3) a 5- to 6-membered heterocyclic ring comprising heteroatoms such as nitrogen, oxygen and/or sulfur atoms, said heterocyclic ring may be fused with a benzene or naphthalene nucleus. When R contains two or more R's such as

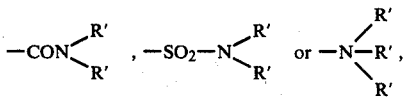

two R's may co-operatively form a nitrogen-containing heterocyclic ring (e.g. piperidine, pryyolidine, morpholine, etc.).

In the general formula [XI], W represents hydrogen, an alkyl group (preferably alkyl of 1 to 18 carbon atoms), an aryl group (preferably a phenyl group, or a naphthyl group), a 5- to 6-membered heterocyclic ring (these rings may have at least one different atoms such as nitrogen, oxygen and sulfur, and further may be fused with a benzene or naphthalene ring (for example, benzoxazole, benzthiazole, etc.)), —Q—D group (the same as Q—D group in the general formulas [VI] and [VII])), halogen (e.g. chlorine or bromine), an alkoxy group (preferably those having 1 to 5 carbon atoms), an aryloxy group (preferably an phenylgroup or a naphthyl group), a heteroaryloxy group (e.g. 5- to 6-membered heterocyclic ring which have at least one hetero atom such as nitrogen, oxygen and sulfur atoms, and which may be fused with benzene or naphthalene ring), an acyloxy group (e.g. the acyl group represents acetyl, propioloyl, palmitoyl as aliphatic acyl group, or benzoyl as aromatic acyl group).

In general formulas [VI], [VII], [VIII], [IX], [X] and [XI], the groups and rings appeared in the general formulas include the substituted as explained before.

The substituents therefor may be any of such substituents as explained in general formulas [I], [II], [III], [III-a], [III-b], [IV] and [V].

Concrete examples of the compounds of general formula [XI] are disclosed together with the synthesis method thereof in U.S. Pat. Nos. 3,928,041 and 3,632,345.

The DIR compound used in the present invention is more preferably the DIR hydroquinone and Colorless development-inhibitor-forming compounds than the DIR coupler which forms a colored dye on reaction with the aromatic primary amine compound. The preferred compounds are represented by general formulas [IX], [X] and [XI].

Typical examples of DIR compound used in the present invention are given below, but the DIR compounds usable in the present invention are not limited to those.

D-1. 1-{4-[γ-(2,4-di-t-Amylphenoxy)butylamido]-phenyl}-3-piperidinyl-4-(1-phenyl-5-tetrazolylthio)-5-pyrazolone D-2. 1-{4-[α-(3-Pentadecylphenoxy)butylamido]-phenyl}-3-ethoxy-4-(1-phenyl-5-tetrazolylthio)-5-pyrazolone D-3. 1-{4-[α-(2,4-di-t-Amylphenoxy)butylamido]-phenyl}-3-pyrrolidino-4-(1-phenyl-5-tetrazolylthio)-5-pyrazolone D-4. 1-(2,4,6-Trichlorophenyl)-3-[3-(2,4-di-t-amylphenoxyacetamido)benzamido]-4-(2-benztriazolyl)-5-pyrazolone D-5. 1-(2,4,6-Trichlorophenyl)-3-[3-(2,4-di-t-amylphenoxyacetamido)benzamido]-4-(1-phenyl-5-tetrazolylthio)-5-pyrazolone D-6. 1-{4-(3-Pentadecylphenoxy)acetamidophenyl}-3-pyrrolidino-4-(1-phenyl-5-tetrazolylseleno)-5-pyrazolone D-7. 2-(2,4-di-t-Amylphenoxyacetamido)-3-(1-phenyl-5-tetrazolylthio)-6,8-dichloro-pyrazolino(1,5-a]benzimidazole D-8. 2-(1-Phenyl-5-tetrazolylthio)-5-n-dodecylthiohydroquinone D-9. 2-n-Octadecyl-5-(1-phenyl-5-tetrazolylthio)-hydroquinone D-10. 1,4-bis-Chloroacetoxy-2-(1-phenyl-5-tetrazolylthio)benzene D-11. 2-(1-Phenyl-5-tetrazolylthio)cyclopentane D-12. 2-(1-Phenyl-5-tetrazolylthio)cyclohexanone D-13. 2-(1-Phenyl-5-tetrazolylthio)-1-indanone D-14. 2,5-bis(1-Phenyl-5-tetrazolylthio)cyclopentanone D-15. 2-(2-Benzthiazolylthio)-4-(2,4-di-t-amylphenoxyacetamido)-1-indanone D-16. 2-(1-Phenyl-5-tetrazolylthio)-4-(2,4-di-t-amylphenoxyacetamido)-1-indanone D-17. 2-(1-Phenyl-5-tetrazolylthio)-6-(2,4-di-t-amylphenoxyacetamido)-1-indanone D-18. 2-(1-Phenyl-5-tetrazolylthio)-4-nitro-6-t-butyl-1-indanone D-19. 2-(1-Phenyl-5-tetrazolylthio)-4-octadecylsuccinimido-1-indanone D-20. 2-(2-Nitrophenylthio)-6-stearoyloxy-cyclohexanone D-21. 2-(2-Benzoxazolylthio)-5-dodecyloxy-cyclopentanone D-22. 2-(1-Phenyl-5-tetrazolylthio)-cyclopentanoneoxime D-23. 2-(1-Phenyl-5-tetrazolylthio)-1-indanonephenylhydrazide D-24. 2-(1-Phenyl-5-tetrazolylthio)-6-(2,4-di-t-amylphenoxyacetamido)-1-indanone-oxime D-25. 2-Bromo-2-(1-phenyl-5-tetrazolylthio)-4-nitro-6-t-butyl-1-indanone D-26. 2-Bromo-2-(1-phenyl-5-tetrazolylthio)-4-nitro-6-t-butyl-1-indanone-oxime D-27. 2-Bromo-2-(1-phenyl-5-tetrazolylthio)-4-nitro-6-butyl-1-indanone D-28. 3-Chloro-3-(1-phenyl-5-tetrazolylthio)-1-N-dodecyl-4-piperidone D-29. 2-Bromo-2-(2-nitrophenylthio)-6-stearoyloxycyclohexanone D-30. 2-(1-Benztriazoyl)-4-(2,4-di-t-amylphenoxyacetamido)-1-indanone D-31. 3-(4-Nitro-1-indazolyl)-1-N-dodecyl-4-piperidone D-32. 2-(5-Methyl-2-benztriazolyl)-5-decylcyclopentanone D-33. 2-(Methyl-1-benztriazolyl)-5-decyl-cyclopentanonephenylhydrazide D-34. 2-(1-Phenyl-5-tetrazolylseleno)-4-octadecylsuccinimido-1-indanone D-35. 2-Bromo-2-(1-phenyl-5-tetrazolylseleno)-4-octadecylsuccinimido-1-indanone D-36. 3-(1-Phenyl-5-tetrazolylseleno)-1-N-dodecyl-4-piperidone D-37. 3-(1-Phenyl-5-tetrazolylthio)-1-N-dodecyl-4-piperidone D-38. 3-(1-Phenyl-5-tetrazolylthio)oxyindole D-39. 1,3-Diphenyl-4-(1-phenyl-5-tetrazolylthio)-hydantoin D-40. 3-(2-Benzthiazolylthio)-N-methyl-4-piperidone D-41. ω-Bromo-ω-(1-phenyl-5-tetrazolylthio)-4-lauroylamidoacetophenone D-42. ω-(1-Phenyl-5-tetrazolylthio)-4-lauroylamidoacetophenone D-43. ω-Chloro-ω-(1-phenyl-5-tetrazolylthio)-4-n-dodecylacetophenone D-44. ω-Chloro-ω-(2-benzozazolylthio)-acetophenone D-45. ω-Acetoxy-ω-(1-phenyl-5-tetrazolylthio)-acetophenone D-46. ω-Phenoxy-ω-(1-phenyl-5-tetrazolylthio)-acetophenone D-47. α-(1-Phenyl-5-tetrazolylthio)-N-octadecyl-acetamide D-48. ω-Bromo-ω-(1-Phenyl-5-tetrazolylseleno)-4-lauroylamidoacetophenone D-49. α-(1-Phenyl-5-tetrazolylseleno)-N-octadecylacetamide In a preferable embodiment of the present invention, the aldehydebis type magenta coupler, the amide compound and the DIR compound are all incorporated into the same one emulsion layer, and further preferable embodiments of the invention, the DIR compound is incorporated into an oil drop containing the aldehydebis type magenta coupler and amide compound, or is incorporated as another oil drop into the emulsion layer containing said oil drop which contains the aldehydebis type magenta coupler and amide compound. In that case, the amount of the DIR compound is incorporated preferably in an amount, in terms of mole, 1/1000 to 10 times, preferably 1/100 to 5 times, the amount of the aforesaid aldehydebis type magenta coupler in the same one silver halide emulsion layer.

The DIR compound is dispersed in the same manner as in the case of the aldehydebis type magenta coupler.

The incorporation into an oil drop containing the aldehydebis type magenta coupler of the so-called 4-equivalent magenta coupler produces favorable results that stability of dispersion is further improved. Such 4-equivalent magenta couplers are those disclosed, for example, in U.S. Pat. Nos. 2,369,489, 2,439,098, 2,511,231, 2,600,788, 2,710,871, 2,933,391, 2,865,751, 3,062,653, 3,152,896, 3,519,429, 3,127,269, 3,061,432, 3,369,897, 3,393,071, 3,462,270, 3,567,449, 3,558,319, 3,677,764, 3,684,514 and 4,063,950. Processes for the synthesis of these 4-equivalent magenta couplers are described in the above-mentioned patents publications or specifications.

Examples of particularly useful 4-equivalent magenta coupler are given below, but those as exemplified should not be construed as limitative.

M-1. 1-(2,4,6-Trichlorophenyl)-3-(3-(2,4-di-t-amylphenoxyacetamido)benzamido)-5-pyrazolone M-2. 1-(2,4,6-Trichlorophenyl)-3-(3-dodecylsuccinimidobenzamido)-5-pyrazolone M-3. 1-(2,4,6-Trichlorophenyl)-3-(2-chloro-5-octadecylsuccinimidoanilino)-5-pyrazolone M-4. 1-(2-Chloro-4,6-dimethylphenyl)-3-{3-[α-(3-pentadecylphenoxy)butylamido]benzamido}-5-pyrazolone M-5. 1-(2,4,6-Trichlorophenyl)-3-(2-chloro-5-octadecylcarbamoylanilino)-5-pyrazolone M-6. 1-(2,4,6-Trichlorophenyl)-3-(2-chloro-5-tetradecaneamidoanilino)-5-pyrazolone M-7. 1-(2,4,6-Trichlorophenyl)-3-{2-chloro-5-{α-(3-t-butyl-4-hydroxyphenoxy)tetradecaneamido]-anilino}-5-pyrazolone M-8. 1-(2,4,6-Trichlorophenyl)-3-{3-[α-(2,4-di-t-amylphenoxy)butylamido]benzamido}-5-pyrazolone In one of the most preferable embodiments of the present invention, the 4-equivalent magenta coupler is incorporated into an oil drop containing aldehydebis type magenta coupler and the compound of the general formula [I] according to the present invention, and the DIR compound is further incorporated into said oil drop or is incorporated as another oil drop into an emulsion layer containing the former oil drop. The amount of the 4-equivalent magenta coupler to be incorporated is preferably 1/1000 to 100 times (preferably 1/100 to 10 times), in terms of mole, the amount of said aldehydebis type magenta coupler.

The light-sensitive silver halide color photographic material of the present invention is illustrated below further in detail.

The light-sensitive silver halide color photographic material in the present invention comprises one or two or more silver halide emulsion layers containing the aldehydebis type magenta coupler used in the invention and/or the amide compound represented by the general formula [I], which emulsion layer or layers are formed on a support of said photographic material.

The silver halide used in the silver halide emulsion layer or layers of a light-sensitive silver halide color photographic material of the present invention can be any silver halides used in a common silver halide photographic emulsion, such as silver chloride, silver bromide, silver iodide, silver chlorobromide, silver iodobromide, silver chloroiodobromide, etc.

Particles of the above-mentioned silver halide may be either coarse or fine, and the distribution of particle size may be either narrow or wide. These silver halide particles may be of either normal crystal or twin crystal, and the particles having any ratio of [100] face to [111] face may be usable. Further, crystal structure of these silver halide particles may be either uniform throughout from inside to outside or of stratum structure, of which the inside portion and outside portion are qualitatively different. These silver halides may be either of the type in which a latent image is mainly formed on the surface thereof or of the type in which the latent image is formed inside the particles thereof. These silver halides may be prepared according to known procedures conventionally employed in the industry concerned.

The silver halide emulsions used in the present invention are preferably treated to remove soluble salts therefrom, but the emulsions from which the soluble salts have not been removed may also usable. Further, mixtures of two or more emulsions which have been prepared separately may also be usable.

Binders used in silver halide emulsion layers of the light-sensitive color photographic materials of the present invention may include gelatine, colloidal albumin, agar, gum arabic, alginic acid, cellulose derivatives such as hydrolyzed cellulose acetate, carboxymethyl cellulose, hydroxyethyl cellulose and methyl cellulose, synthetic binders, for example, polyvinyl alcohol, partially saponified polyvinyl acetate, polyacrylamide, poly N,N-dimethylacrylamide, and, N-vinyl pyrrolidone, water-soluble polymers, gelatin derivatives such as phenylcarbamylated gelatin, acylated gelatin and phthalated gelatin, and such binders as prepared by graft copolymerizing monomers having polymerizable groups such as acrylic acid (ester), methacrylic acid (ester) and acrylonitrile, on gelatin. These binders may be used, if necessary, in the form of compatible mixture of two or more binders.

The solver halide photographic emulsions mentioned previously may be sensitized with chemical sensitizers. The chemical sensitizers which may be advantageously usable in the present invention may be roughly classified into four types, i.e. noble metal sensitizers, sulfur sensitizers, selenium sensitizers and reductive sensitizers.

The photographic emulsions may further be subjected, if necessary, to spectral sensitization or strong color sensitization using cyanine dyes such as cyanine, merocyanine and carbocyanine, either singly or in the combination thereof, or using these cyanine dyes in combination with styryl dyestuffs. Selection of the sensitizing technique may be optionally made according to a wavelength region to be sensitized and sensitivity, purposes and used of the end light-sensitive silver halide color photographic material.

In the present invention, the silver halide emulsion layer or layers may be incorporated with stabilizers.

The silver halide emulsions of the present invention may be incorporated with development accelerators.

Film hardening treatment of the emulsions is carried out according to ordinary procedure.

The hardeners used in the film hardening treatment include ordinary photographic hardeners, for example, aldehyde type compounds such as formaldehyde, glyoxal and tartaraldehyde and thier derivative compounds such as addition products thereof with acetal or sodium bisulfite; methanesulfonic acid ester type compounds; mucochloric acid or mucohalogen acid type compounds; epoxy type compounds; azilidine type compounds; active halogen type compounds; maleic acid imide type compounds; active vinyl type compounds; carbodiimide type compounds; isoxazole type compounds; N-methylol type compounds; isocyanate type compounds; and inorganic hardeners such as chrome alum, zirconium sulfate, etc.

The silver halide emulsions in the present invention may be incorporated with surface active agents used either singly or in combination of two or more.

The surface active agents, which are used as agents for improving coat aids, emulsifiers and processing solutions in permeability, defoaming agents, antistatic agents, antiadhesion agents and as materials to improve photographic properties or control physical properties, includes various surfactants, for example, natural products such as saponin, nonionic surfactants of alkyleneoxide-, glycerin- and glycidal types, cation surfactants such as higher alkylamines, pyridine and other heterocycles, quaternary nitrogen onium salts and phophonium or sulfonium salts, anion surfactants containing acidic groups such as carboxylic acid, sulfonic acid, phosphoric acid, sulfuric ester and phosphoric ester, and amphoteric surfactants such as amino acids and aminosulfonic acids.

The light-sensitive silver halide color photographic material in the present invention comprises a support and thereon a silver halide emulsion layer or layers containing the aldehydebis type magenta coupler used in the invention and the amide compound represented by the general formula [I]. As one of preferred embodiments of the light-sensitive color photographic materials of the present invention, there is provided a multicoated light-sensitive color photographic material having on a support thereof a blue-sensitive silver halide emulsion layer containing a yellow coupler, a green-sensitive silver halide emulsion layer containing the aldehydebis type magenta coupler and amide compound mentioned above, and a red-sensitive silver halide emulsion layer containing a cyan coupler.

In the photographic materials of the kind mentioned above, known emulsions may suitably be used as the blue-sensitive, green-sensitive and red-sensitive emulsions, respectively.

As the yellow coupler, there have heretofore been used open chain ketomethylene compounds, and usable yellow couplers in the present invention include benzoylacetanilide type yellow couplers and pivaloylacetanilide type yellow couplers which are being used widely. Further, 2-equivalent type yellow couplers, of which the carbon atom at the coupling position has been substituted with a substituent capable of being released at the time of coupling reaction, are also being used advantageously. Concrete examples of particularly effective yellow couplers used in the present invention are given below.

Y-1. α-(4-Carboxyphenoxy)-α-pivalyl-2-chloro-5-[γ-(2,4-di-t-amylphenoxy)butylamido]acetanilide Y-2. α-Pivalyl-2-chloro-5-[γ-(2,4-di-t-amylphenoxy)-butylamido]acetanilide Y-3. α-Benzoyl-2-chloro-5-[α-(dodecyloxycarbonyl)-ethoxycarbonyl]acetanilide Y-4. α-(4-carboxyphenoxy)-α-pivalyl-2-chloro-5-[α-(3-pentasecylphenoxy)butylamido]acetanilide Y-5. α-(1-Benzyl-2,4-dioxo-3-imidazolidinyl)-α-pivalyl-2-chloro-5-[γ-(2,4-di-t-amylphenoxy)-butylamido]acetanilide Y-6. α-[(4-(1-Benzyl-2-phenyl-3,5-dioxo-1,2,4-triazolidinyl)]-α-pivalyl-2-chloro-5-[γ-(2,4-di-t-amylphenoxy)butylamido]acetanilide Y-7. α-Acetoxy-α-{3-[α-(2,4-di-t-amylphenoxy)-butylamido]benzoyl}-2-methoxyacetanilide Y-8. α-{3-[α-(2,4-di-t-Amylphenoxy)butylamido]-benzoyl}-2-methoxyacetanilide Y-9. α-[4-(4-Benzyloxyphenylsulfonyl)phenoxy]-α-pivalyl-2-chloro-5-[γ-(2,4-di-t-amylphenoxy)-butylamido]acetanilide Y-10. α-Pivalyl-α-(4,5-dichloro-3(2H)-pyridazo-2-il)-2-chloro-5-[(hexadecyloxycarbonyl)methoxycarbonyl-]acetanilide Y-11. α-Pivalyl-α-[4-(p-chlorophenyl)-5-oxo-$\Delta^2$-tetrazoline-1-il]-2-chloro-5-[α-(dodecyloxycarbonyl)ethoxycarbonyl]acetanilide Y-12. α-(2,4-Dioxo-5,5-dimethyloxazolidine-3-il)-α-pivalyl-2-chloro-5-[α-(2,4-di-t-amylphenoxy)-butylamido]acetanilide Y-13. α-Pivalyl-α-[4-(1-methyl-2-phenyl-3,5-dioxo-1,2,4-triazolidinyl)]-2-chloro-5-[γ-(2,4-di-t-amylphenoxy)butylamido]acetanilide Y-14. α-Pivalyl-α-[4-(p-ethylphenyl)-5-oxo-$\Delta^2$-tetrazoline-1-il]-2-chloro-5-[γ-(2,4-di-t-amylphenoxy)-butylamido]acetanilide Cyan couplers generally used in the present invention are phenol or naphthol derivatives.

Examples of cyan coupler useful in the present invention are given below.

C-1. 1-Hydroxy-N-[δ-(2,4-di-t-amylphenoxy)butyl]-2-naphthamide

C-2. 2,4-Dichloro-3-methyl-6-(2,4-di-t-amylphenoxyacetamido)phenol

C-3. 2,4-Dichloro-3-methyl-6-[α-(2,4-di-t-amylphenoxy)butylamido]phenol

C-4. 1-Hydroxy-4-(3-nitrophenylsulfonamido)-N-[δ-(2,4-di-t-amylphenoxy)butyl]-2-naphthamide C-5. 1-Hydroxy-4-[(β-methoxyethyl)carbamoyl)-methoxy-N-[δ-(2,4-di-t-amylphenoxy)butyl]-2-naphthamide C-6. Hydroxy-4-(isopropylcarbamoyl)methoxy-N-dodecyl-2-naphthamide C-7. 2-Perfluorobutylamido-5-[α-(2,4-di-t-amylphenoxy)hexaneamido]phenol C-8. 1-Hydroxy-4-(4-nitrophenylcarbamoyl)oxy-N-[δ-(2,4-di-t-amylphenoxy)butyl]-2-naphthamide C-9. 2-(α,α,β,β-Tetrafluoropropionamido)-5-[α-(2,4-di-t-amylphenoxy)butylamido]phenol C-10. 1-Hydroxy-N-dodecyl-2-naphthamide C-11. 1-Hydroxy-4-(4-nitro)phenoxy-N-[δ-(2,4-di-t-amylphenoxy)butyl]-2-naphthamide C-12. 1-Hydroxy-4-(1-phenyl-5-tetrazolyloxy)-N-[δ-(2,4-di-t-amylphenoxy)butyl]-2-naphthamide C-13. 2-(α,α,β,β-Tetrafluoropropionamido)-4-β-chloroethoxy-5-[α-(2,4-di-t-amylphenoxy)-butylamido]phenol C-14. 2-Chloro-3-methyl-4-ethylcarbamoylmethoxy-6-[α-(2,4-di-t-amylphenoxy)butylamido]phenol The green-sensitive or red-sensitive silver halide emulsion layer in the light-sensitive silver halide color photographic material of the present invention may be incorporated with colorless or colored 2-equivalent magenta coupler and further incorporated with a colored 2-equivalent magenta coupler.

The colored magenta couplers, i.e. the so-called colored magenta couplers, include such compounds as disclosed, for example, in U.S. Pat. Nos. 2,801,171, 2,983,360, 3,005,712 and 3,684,514, and British Pat. No. 937,621. Further, there may be also used such colored magenta couplers as disclosed in U.S. Pat. No. 3,419,391, which couplers are of the type that as a result of reaction of the coupler with an oxidation product of developing agent, the dye formed thereby comes to flow out into a processing bath.

Generally usable as the so-called colored cyan couplers, are such compounds as disclosed, for example, in U.S. Pat. Nos. 2,521,908 and 3,034,892, and British Pat. No. 1,255,111. Further, there may be used such colored cyan couplers as disclosed in U.S. Pat. No. 3,476,563, which couplers are of the type that as a result of reaction of the coupler with an oxidation product of developing agent, the dye formed comes to flow out into a processing bath.

Further, for the purposes of controlling gradation and preventing color stain and fog formations, there may be also used likewise the so-called wise couplers disclosed in U.S. Pat. No. 2,998,314, and British Pat. No. 1,284,649.

As antistain agents used for preventing the formation of fog or stain which is often brought about as a result of unnecessary reaction of coupler with oxidized developing agent due to air oxidation or the like causes, there may be generally used hydroquinone type compounds.

For the purposes of preventing the photographic film from being scratched by reducing sliding friction on the film, lubricants are applied to the backside of film, and the uppermost layer formed on the silver halide emulsion layer.

Useful materials as lubricants, are sodium sulfate of higher alcohol, higher alcohol esters of higher fatty acids, carbowaxes, higher alkylphosphoric acid esters and silicone type compounds.

In addition to silver halide emulsion layers, the light-sensitive silver halide color photographic material of the present invention may be suitably provided with auxiliary layers such as protective layers, intermediate layers, filter layers, antihalation layers, subbing layers and backing layers.

The light-sensitive silver halide color photographic material of the present invention may be incorporated in its constitutive layers (e.g. protective layer, intermediate layers, emulsion layers, backing layers, etc.) with ultraviolet absorbers. Particularly, products of Ciba-Geigy Co., i.e. Thinubin PS, Thnubin 320, 326, 327 and 328 are preferably used either singly of combination of two or more.

The light-sensitive silver halide color photographic material is prepared by forming its constitutive layers on a support excellent in flatness and less in dimentional change during either manufacturing step or processing step. In that case, usable support materials are those having suitable hardness, such as plastic films, plastic laminated paper, baryta paper, synthetic paper, glass plate, metal and ceramic materials. Concretely, the support may includes films of cellulose acetate, cellulose nitrate, polyvinyl acetal, polypropylene, polyethylene terephthalate, polyamide, polycarbonate and polystyrene, or polyethylene laminated paper, polypropylene synthetic paper and baryta paper, and these supports may be suitably selected according to the purpose for which the light-sensitive silver halide color photographic material thereby obtained is used.

Generally, these support are subjected to subbing in order to strenghen the adhesion thereof to photographic emulsion layers. Typical materials used in subbing treatment include copolymerized products of vinyl chloride or vinylidene chloride, copolymerized products of esters of vinyl alcohol, copolymerized products containing unsaturated carboxylic acid, copolymerized products of dienes such as butadiene, copolymerized products of acetals, copolymerized products of unsaturated carboxylic anhydrides such as maleic anhydride, copolymerized products of vinyl alcohol ester, particularly vinyl acetate, or styrene, or ring-opened products thereof by the action of water, alkali, alcohols or amines, and further, cellulose derivatives such as nitrocellulose, diacetylcellulose, etc., compounds containing epoxy groups, gelatin or modified gelatin products, and polyolefin copolymerized products.

The subbing treatment may be effected by using the above-mentioned subbing materials in combination with gelatin or polyols, monovalent or polyvalent phenols and their halogen-substituted compounds, cross-linking agents (film hardeners) and metal oxides.

In the practice of subbing treatment of a support, the aforesaid subbing materials may be used either singly or in combination of two or more, and the subbing layer thereby formed may be a single or double layer. Of course, an intermediate sublayer may be provided between the upper and lower subbing layers, said intermediate subbing layer comprising a combination of the subbing materials used in said upper and lower subbing layers, and thus there is provided the subbing layer of multi-coated structure. For example, there is a subbing technique in which a gelatin layer is coated on a vinylidene chloride copolymerized product layer, or a subbing technique in which a layer comprising a vinylidene chloride copolymerized product, a layer comprising a mixture of gelatin and the vinylidene chloride polymerized product, and a gelatin layer are successively coated on a support in that order. The subbing techniques may be selected suitably according to the purpose.

In addition to the above-mentioned subbing treatment using the subbing materials, the support may be subjected to such treatments as corona discharge, glow discharge, other electron bombardment, flame treatment, ultraviolet irradiation, oxidation treatment, saponification treatment and surface coarsening treatment. These treatments may be employed either singly or in combination of two or more, and the subbing treatment may be sufficiently effected by employing these treatments in combination with the aforesaid subbing treatment using the subbing materials.

Selection of coating techniques of silver halide emulsion layers and other layers constituting a light-sensitive silver halide photographic material is important in order to secure uniformity of quality and productivity of the photographic material. The coating technique adopted may be selected, for example, from dip coating, double roll coating, air knife coating, extrusion coating and curtain coating. Of the above-mentioned coating techniques, the extrusion coating and curtain coating techniques are particularly useful, wherein two or more layers can be simultaneously coated on the photographic support. Coating speed may be optionally selected. However, the speed of 30 m/min or faster is preferable from the standpoint of productivity.

In the case of using such additives as hardeners, which, when incorporated into a coating solution in advance, bring about gelation of the coating solution, they are preferably incorporated, immediately before coating, into the coating solution by the use of a static mixer or the like.

After light exposure, the light-sensitive silver halide color photographic material is subjected to color development according to commonly used procedures to give an color image thereon.

There is no particular restriction as to processing of light-sensitive color photographic material in the present invention, and the present light-sensitive silver halide color photographic materials may be applicable to any processing techniques. Typical examples of such processing techniques include a process in which the bleach-fixing treatment is conducted after the color development and then, if necessary, water-washing and stabilizing treatments follow, as disclosed in U.S. Pat. No. 3,582,322; a process in which the bleaching and fixing treatments are separately carried out and then water-washing and stabilizing treatments are effected, if necessary, as disclosed in U.S. Pat. No. 910,002; a process in which the prehardening, neutralizing, color development, stopping-fixing, water-washing, bleaching, fixing, water-washing, post-hardening and water-washing are carried out in that order, as disclosed in U.S. Pat. No. 3,582,347; a process in which the color development, water-washing, auxiliary color development, stopping, bleaching, fixing water-washing and stabilizing treatments are conducted in that order, as disclosed in Japanese Laid-Open-to-Public Publication No. 54330/1975; a process in which prehardening, neutralizing, water-washing, first development, stopping, water-washing, color development, stopping, water-washing, bleaching, fixing and water-washing treatments in that order, as disclosed in U.S. Pat. No. 3,607,263; a process in which the prehardening, neutralizing, first development, stopping, water-washing, color development, stopping, water-washing, bleaching, organic acid bath, fixing and water-washing treaments are carried out in that order, as disclosed in Japanese Laid-Open-to-Public Publication No. 36126/1975; a process in which the first development, non-fixing silver dye bleach, water-washing, color development, acid rinsing, water-washing, bleaching, water-washing, fixing, water-washing fixing, water-washing, stabilizing and water-washing treatments are conducted in that order, as disclosed in Japanese Laid-Open-to-Public Publication No. 81538/1975; a process in which a developed silver image formed by color development is subjected to halogenation bleach and then color development is again conducted to increase the amount of dye formed thereby, as disclosed in U.S. Pat. Nos. 2,623,822 and 2,814,565; and a process in which low silver content light-sensitive silver halide photographic materials are processed with amplifying agents such as peroxides or cobalt complex salts, and any of these processes may be applicable to the photographic materials of the present invention. These processings are carried out in some cases at an elevated temperature above 30° C. for the purposes of quick processing, and are carried out in some cases at room temperature or at 20° C. or lower in special cases. The processing is advantageously conducted generally in the temperature range of from 20° C. to 70° C. The established temperature to be employed in a series of processing steps may be the same or different.

Color developing agents are typically those of p-phenylene diamine type, and preferable examples of the color developing agent may be mentioned as follows:

4-Amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 3-β-methanesulfonamidoethyl-4-amino-N,N-diethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-diethylaniline, 4-amino-N,N-dimethylaniline, N-ethyl-N-β-(β-methoxyethoxy)ethyl-3-methyl-4-aminoaniline, N-ethyl-N-β(β-methoxyethoxy)ethyl-3-methyl-4-aminoaniline and their salts, for example, sulfates, hydrochlorides, sulfite and p-toluenesulfonates.

Furthermore, the color developing solution may be incorporated, if necessary, with various additives. Typical examples of such additives may include alkali agents (e.g. hydroxides, carbonates and phosphates of alkali metals or ammonium), pH regulators or buffers (e.g. weak acid or base such as acetic acid and boric acid and salts thereof), development accelerators (e.g. various pyridinum compounds, cationic compounds, potassium nitrate and sodium nitrate, polyethylene glycol condensates or their derivatives, nonionic compounds such as polythioethers, polymer compounds having sulfite esters, and, in addition thereto, pyridine, ethanolamines, organic amines, benzyl alcohol, hydrazines, etc.), antifoggants (e.g. alkali bromides, alkali iodides, nitrobenzoimidazoles, mercaptobenzoimidazole, 5-methylbenzotriazole and 1-phenyl-5-mercaptotetrazole, compounds for quick processing solutions, nitrobenzoic acids, benzothiazolium derivatives or phenadine-N-oxides), and stain or sludge preventing agents, multilayer effect promoting agents and preservatives (e.g. sulfites, acidic sulfites, hydroxylamine hydrochloride, formulfite, alkanolainesulfite addition products, etc.).

The light-sensitive photographic material of the present invention is subjected, after color development, to bleaching according to an ordinary procedure. The processing may be carried out simultaneously in combination with fixing, or may be conducted separately. The processing solution used in the bleaching may be incorporated, if necessary, with fixing agent, thereby to prepare a bleach-fixing solution.

The bleaching agent may include various kinds of compounds. Such compounds generally usable as bleaching agents include, for example, ferricyanides, bichromates, iron (III) aminopolycarboxylic acids, metal salts of aliphatic polycarboxylic acids, persulfate; copper complex salts; cobalt complex salts; iodine; bleaching powder and sulfamic acid; quinones; and p-sulfophenylquinones or nitroso compounds, and these compounds may stably be used, either singly or incombination, in the present invention as bleaching agents for processing the light-sensitive photographic materials of the present invention.

Further, the bleaching or bleach-fixing solutions may be incorporated with various additives, including bleach accelerators.

The light-sensitive photographic materials of the present invention are more effective when they are used as color photographic materials having small silver content as shown in West German Patent (OLS) No. 2,357,964. Said patent publication disclosed color photographic materials, the silver content of which is from one-severalth to one-hundredth of that of ordinary color photographic materials, for example, a single layer of the patent color photographic materials contains about 65–375 mg/m$^2$ of silver halide.

The light-sensitive silver halide color photographic material, in which a content of silver halide has been decreased, can give favorable results by applying thereto a development process disclosed, for example, in U.S. Pat. Nos. 2,623,822 and 2,814,565, wherein the developed silver formed by color development is subjected to halogenation bleach and then subjected again to color development, thereby to increase the amount of dye formed thereby, or a development process disclosed, for example, in U.S. Pat. Nos. 3,674,490 and 3,761,265, West German Patent (OLS) No. 2,056,360 and Japanese Laid-Open-to-Public Publication Nos. 6338/1972 and 10538/1972, wherein the development is carried out using peroxides, or a development process disclosed, for example, in West German Patent (OLS) No. 2,226,770 and Japanese Laid-Open-to-Public Publication No. 9728/1973, wherein the development is effected by utilizing color amplifying power by the use of cobalt complex salts.

EXAMPLE 1

There were used as aldehydebis type magenta couplers, couplers B-10, B-3, B-78, B-21, B-24, B-33, B-37, B-45, B-8, B-11 and B-13 and, as comparative couplers, coupler M-1 which is a 4-equivalent coupler and a 2-equivalent coupler M'-1 which had been prepared by substituting hydrogen at the 4-position of pyrazolone nucleus of coupler M-1 by an acetoxy group. There were used, as high boiling organic solvents, amide compounds A-3, A-5, A-16, A-19 and A-25 and, as high boiling point organic solvents for comparison, tricresyl phosphate (hereinafter called "TCP") and dioctyl phthalate (hereinafter called "DOP"). Each aldehydebis type magenta coupler in an amount of $4\times10^{-2}$ mole per mole of silver halide and each comparative coupler in an amount of $8\times10^{-2}$ mole per mole of silver halide were individually admixed, according to the mode of combination as shown in Table 1, with each high boiling-point organic solvent in an amount equal to the weight of each coupler. Each of the resulting mixtures was incorporated with ethyl acetate and heateded to obtain a complete solution. Each of the solution thus obtained was mixed with 50 ml of a 10% aqueous solution of Alkanol B (a registered trade mark of alkylnaphthalene sulfonate produced and sold by Du Pont Co.) and 700 ml of a 10% aqueous gelatin solution and dispersed by means of a colloid mill to prepare a dispersion comprising each coupler in combination with each high boiling-point organic solvent. The thus prepared dispersions were individually incorporated into 1 mole of a silver iodobromide emulsion (containing 7 mol% of silver iodide), each of the resulting emulsions was incorporated with 4-hydroxy-6-methyl-1,3,3a,7-tetrazaindene and saponin. The emulsions thus treated were individually coated on a cellulose triacetate film support and then dried to obtain samples of light-sensitive silver halide color photographic materials, each having a stable color photographic emulsion layer formed on the support thereof. Each of the samples thus obtained was exposed by means of a sensitometer of KS-1 Model (manufactured by Konishiroku Photo Industry Co., Ltd.) through an optical wedge to white light and then subjected to the following color photographic processing step to obtain two kinds of samples of magenta color developed images for each of the samples of color photographic materials thus processed:

| (Processing step) (37.8° C.) | | Processing time |
|---|---|---|
| 1. | color development | 3 minutes 15 seconds |
| 2. | Bleaching | 6 minutes 30 seconds |
| 3. | Water-washing | 3 minutes 15 seconds |
| 4. | Fixing | 6 minutes 30 seconds |
| 5. | Water-washing | 3 minutes 15 seconds |
| 6. | Stabilizing | 1 minute 30 seconds |
| 7. | Drying | |

In the above-mentioned processing step, each sample was divided into two portions after completion of color development, and one of the two portions was treated with a bleaching solution -(1) of normal potential, and the other with a bleaching solution -(2) of lower potential. Thereafter both the portions of each samples thus treated were simultaneously subjected to the subsequent treatments.

| Composition of color developing solution | |
|---|---|
| 4-Amino-3-methyl-N-ethyl-N-(β-hydroxyethyl)aniline sulfate | 4.8 g |
| Anhydrous sodium sulfite | 0.14 g |
| Hydroxyamine ½ sulfate | 1.98 g |
| Sulfuric acid | 0.74 g |
| Anhydrous potassium carbonate | 28.85 g |
| Anhydrous potassium bicarbonate | 3.46 g |
| Potassim bromide | 1.16 g |
| Sodium chloride | 0.14 g |
| Trisodium nitrilotriacetate (monohydrate) | 1.20 g |
| Potassium hydroxide | 1.48 g |
| Water to make | 1 liter |

| Composition of bleaching solution: | |
|---|---|
| Iron ammonium ethylenediaminetetraacetate | 100.0 g |
| Diammonium ethylenediaminetetraacetate | 0.0 g |
| Ammonium bromide | 150.0 g |
| Glacial acetic acid | 10.0 ml |
| Water to make 1 liter and adjust to pH with ammonia water. | 6.0 |

| Composition of fixing solution: | |
|---|---|
| Ammonium thiosulfate | 170.5 g |
| Anhydrous sodium sulfite | 8.6 g |
| Sodium metasulfite | 2.3 g |
| Water to make 1 liter and adjust to pH with acetic acid. | 6.0 |

| Composition of stabilizing solution: | |
|---|---|
| Formalin | 1.5 ml |
| Konidax (produced and sold by Konishiroku Photo Industry Co., Ltd.) | 7.5 ml |
| Water to make | 1 liter |
| Bleaching solution-(1) | The above-mentioned bleaching solution of a potential of about 340 mV. |

-continued

| Composition of stabilizing solution: | |
|---|---|
| Bleaching solution-(2) | The above-mentioned bleaching solution was incorporated with silver powder so as to decrease the above-mentioned potential to about 240 mV. |

The bleaching solution -(2) was assumed to be such a fatiguing bleaching solution with decreasing bleaching ability as may be practically observed in a color development laboratory, and the decrease of bleaching ability was expressed in terms of decrease of potential as a model case for expressing decrease in bleaching ability of the bleaching solution used.

The potential values of the bleaching solutions -(1) and -(2) were determined by the use of a calomel electrode as a reference electrode and a platinum electrode as an indicative electrode.

The magenta color dye images obtained in the above manner were individually measured in fog, relative speed (assuming as 100 for Sample 1 shown in Table 1), gamma (expressed in terms of tan $\theta$ of the characteristic curve) and maximum density (Dmax).

The results obtained in the above measurements were also shown in Table 1.

Table 1

| Sample No. | Combination of Coupler and High boiling-point organic solvent | Bleaching solution-1 Fog | Relative speed | Gumma | Dmax | Bleaching solution-2 Fog | Relative speed | Gumma | Dmax |
|---|---|---|---|---|---|---|---|---|---|
| 1 | M-1+TCP | 0.15 | 100 | 0.65 | 1.70 | 0.15 | 100 | 0.65 | 1.70 |
| 2 | M-1+A-5 | 0.20 | 95 | 0.63 | 1.71 | 0.20 | 95 | 0.62 | 1.70 |
| 3 | M'-1+TCP 0.18 | 102 | 0.85 | 2.12 | 0.18 | 101 | 0.85 | 2.10 | |
| 4 | M'-1+A-5 | 0.25 | 98 | 0.81 | 2.13 | 0.25 | 98 | 0.82 | 2.12 |
| 5 | B-10+TCP | 0.14 | 123 | 0.70 | 1.85 | 0.10 | 52 | 0.31 | 0.74 |
| 6 | B-10+DOP | 0.15 | 120 | 0.69 | 1.80 | 0.11 | 47 | 0.29 | 0.70 |
| 7 | B-10+A-5 | 0.15 | 178 | 0.85 | 2.20 | 0.15 | 180 | 0.84 | 2.20 |
| 8 | B-10+A-3 | 0.14 | 160 | 0.83 | 2.15 | 0.14 | 159 | 0.83 | 2.14 |
| 9 | B-10+A-16 | 0.13 | 172 | 0.81 | 2.18 | 0.13 | 170 | 0.82 | 2.20 |
| 10 | B-10+A-19 | 0.16 | 170 | 0.85 | 2.25 | 0.15 | 167 | 0.84 | 2.23 |
| 11 | B-10+A-25 | 0.15 | 165 | 0.79 | 2.10 | 0.14 | 165 | 0.80 | 2.11 |
| 12 | B-3+A-3 | 0.15 | 145 | 0.82 | 2.12 | 0.14 | 125 | 0.70 | 1.64 |
| 13 | B-78+A-3 | 0.16 | 160 | 0.85 | 2.20 | 0.15 | 120 | 0.71 | 1.67 |
| 14 | B-21+A-3 | 0.15 | 155 | 0.81 | 2.14 | 0.15 | 135 | 0.74 | 1.90 |
| 15 | B-24+A-3 | 0.13 | 170 | 0.83 | 2.25 | 0.13 | 140 | 0.75 | 1.85 |
| 16 | B-33+A-3 | 0.17 | 165 | 0.84 | 2.10 | 0.16 | 148 | 0.74 | 1.80 |
| 17 | B-37+A-3 | 0.15 | 148 | 0.82 | 2.08 | 0.14 | 135 | 0.77 | 1.95 |
| 18 | B-45+A-3 | 0.16 | 150 | 0.81 | 2.24 | 0.15 | 140 | 0.79 | 2.00 |
| 19 | B-8+A-3 | 0.15 | 175 | 0.85 | 2.21 | 0.15 | 176 | 0.85 | 2.21 |
| 20 | B-11+A-3 | 0.15 | 180 | 0.83 | 2.18 | 0.15 | 180 | 0.82 | 2.19 |
| 21 | B-13+A-3 | 0.14 | 170 | 0.84 | 2.22 | 0.14 | 1170 | 0.84 | 2.20 |

As is clear from the results of samples 1–7 shown in Table 1, it is understood that by the use of amide compound A-5 in combination with aldehydebis type magenta coupler B-10 in accordance with the present invention, sample 7 of the present invention demonstrates such characteristics as could not be expected at all from a common knowledge of the prior art, which characteristics are such that, in the case of sample 7, the formation of fog is effectively suppressed, both a speed and a maximum density are further improved and photographic properties do not substantially change due to changes in potential of the bleaching solution (i.e. this means an excellent property of the sample being stable against processing). It is a fact in this connection that in the case of amide compound A-5 being used in combination with 4-equivalent magenta coupler M-1 as well as with 2-equivalent magenta coupler M'-1, the formation of fog is high and also the speed is slightly low as compared with in the case of TCP being used in combination with said 4-equivalent magenta coupler as well as with said 2-equivalent magenta coupler, and that in the case of the aldehydebis type magenta coupler B-10 being used in combination with TCP or DOP, the formation of fog is effectively suppressed in the bleaching step by using bleaching solution -(1) of normal potential, the speed is high as compared with in the case of 4-equivalent magenta coupler M-1 being used in combination with TCP and 2-equivalent magenta coupler M'-1 being used in bombination with TCP, and the maximum density is high as compared with in the case of said 4-equivalent magenta coupler being used in combination with TCP but when samples 5 and 6 comprising a combination of B-10 and TCP and combination of B-10 and DOP, respectively, are bleached with the bleaching solution -(2) of low potential, the speed as well as the maximum density are inversely found to be low and thus samples 5 and 6 comprising the aldehydebis type magenta coupler B-10 in combination with TCP and DOP, respectively, greatly change in photographic properties due to a change in potential of the bleaching solution employed (i.e. this means that both samples 5 and 6 are poor in stability against processing). As can be seen from the results of samples 8–11, it is understood that the aforesaid excellent characteristics are demonstrated even when aldehydebis type magenta coupler B-10 is used in combination with the present amide compounds other than amide compound A-5. Further, as is clear from the results of samples 11–21, it is understood that all the aldehydebis type magenta couplers of the present invention demonstrate excellent effects when used in combination with the amide compound of the present invention. As is clear from a comparison between the results of samples 12–13, 14–18 and further 19–21, furthermore, it is understood that among the aldehydebis type magenta couplers of general formula [II] in the present invention, when the aldehydebis type magenta couplers used in samples 14–18, in the general formula of which A- and B- are individually a coupler residue of general formula [III-a] and/or [III-b], are used, the resulting silver halide photographic materials are found to be further excellent in processing stability, and further that when the aldehydebis type magenta couplers of general formula [V] used in samples 19–21 are used, the resulting silver halide color photographic materials do not substantially change in photographic properties due to a change in potential of the bleaching solution employed, demonstrate the most excellent processing stability and are highest in speed and thus the aldehydebis type magenta couplers of general formula [V] are most preferable among the aldehydebis type magenta couplers of the present invention.

EXAMPLE 2

The samples of magenta color dye images obtained in Example 1 were subjected for 48 hours to irradiation using a Xenon fade-o-meter (6 X HC Model, manufactured by Toyo Rika Kogyo K.K.) and then measured again in maximum density to investigate light-fastness of the color images due to irradiation of light. Further, these samples were stored for 2 weeks at 70° C. and RH 80% and then measured again in maximum density to investigate the color dye images in moisture resistance due to humidity. The results obtained were shown in Table 2, wherein the light fastness and moisture resistance of the colored dye image were represented by the residual ratio of image in terms of percentages of the densities determined before irradiation and moisture processings, respectively, to those determined after said processings.

Table 2

| Sample No. | Combination of Coupler and High boiling point organic solvent | Irradiation | | Moisture | |
|---|---|---|---|---|---|
| | | Bleaching solution-(1) | Bleaching solution-(2) | Bleaching solution-(1) | Bleaching solution-(2) |
| 1 | M-1+TCP | 48% | 46% | 76% | 75% |
| 2 | M-1+A-5 | 46 | 45 | 73 | 74 |
| 3 | M'-1+TCP | 40 | 43 | 77 | 77 |
| 4 | M'-1+A-5 | 42 | 40 | 74 | 73 |
| 5 | B-10+TCP | 50 | 28 | 80 | 36 |
| 6 | B-10+DOP | 49 | 27 | 79 | 32 |
| 7 | B-10+A-5 | 72 | 73 | 89 | 88 |
| 8 | B-10+A-3 | 76 | 75 | 90 | 91 |
| 9 | B-10+A-16 | 71 | 71 | 87 | 86 |
| 10 | B-10+A-19 | 75 | 74 | 88 | 87 |
| 11 | B-10+A-25 | 76 | 76 | 88 | 89 |
| 12 | B-3+A-3 | 69 | 69 | 81 | 81 |
| 13 | B-78+A-3 | 71 | 72 | 80 | 82 |
| 14 | B-21+A-3 | 69 | 69 | 83 | 83 |
| 15 | B-24+A-3 | 72 | 71 | 85 | 84 |
| 16 | B-33+A-3 | 71 | 70 | 82 | 81 |
| 17 | B-37+A-3 | 73 | 74 | 84 | 85 |
| 18 | B-45+A-3 | 72 | 73 | 85 | 85 |
| 19 | B-8+A-3 | 79 | 78 | 90 | 89 |
| 20 | B-11+A-3 | 80 | 79 | 92 | 90 |
| 21 | B-13+A-3 | 75 | 74 | 89 | 89 |

As is clear from a comparison of the results between samples 1–4 and samples 5–6 in Table 2, when the samples comprising aldehydebis type magenta coupler B-10 of the present invention in combination with the high boiling-point organic solvent TCP or DOP are treated with the bleaching solution -(1), they are superior in light fastness as well as in moisture resistance to the samples respectively comprising the 4-equivalent and 2-equivalent magenta couplers, but the former samples are inversely inferior in light fastness as well as in moisture resistance to the latter when they are treated with the bleaching solution -(2). That is, it is understood therefrom that the samples comprising the present aldehydebis type magenta coupler B-10 in combination with TCP or DOP greatly change in light fastness as well as in moisture resistance due to change in potential of the bleaching solution employed. However, as can be clearly seen from the results of samples 7–11, it is understood that when aldehydebis type magenta coupler B-10, which is poor in processing stability necessary for the purpose of preserving the formed image when used in combination with TCP or DOP as a high boiling-point organic solvent, is used in combination with amide compound A-3, A-5, A-16, A-19 or A-25 according to the present invention, the resulting samples in each case are greatly improved in both light fastness and moisture resistance and, the results of the samples even when treated with the bleaching solution of low potential do not substantially differ from those of the samples treated with the bleaching solution of normal potential.

As is clear from a comparison of results between samples 12–13, samples 14–18, and samples 19–21, moreover, it is understood that as is the case with the results obtained in Example 1, among the aldehydebis type magenta couplers of the present invention, couplers B-21, B-24, B-33, B-37 and B-45 are superior to couplers B-3 and B-7 in both light fastness and moisture resistance of the images formed thereby and couplers B-8, B-11 and B-13 are by far superior to those referred to above and are most preferable. Furthermore, it is understood that all the aldehydebis type magenta couplers of the present invention, when used in combination with the amide compounds according to the present invention, are found excellent in processing stability in terms of image preservability.

EXAMPLE 3

Such dispersions as shown in Table 3 were prepared in the same procedure as in Example 1 using exemplified couplers B-11, 4-equivalent magenta coupler M-8 as a comparative coupler, exemplified amide compound A-5 as a high boiling-point organic solvent, and a high boiling-point organic solvent TCP for comparison purposes.

Table 3

| | Materials and Contents | Sample No. 1 | 2 | 3 | 4 | 5 | 6 | 7 | 8 |
|---|---|---|---|---|---|---|---|---|---|
| Disposition Composition (I) | Coupler | M-8:55g | B-11:66g | B-11:55g | B-11:55g | B-11:55g | B-11:55g | B-11:55g | B-11:55g |
| | High boiling point organic solvent | TCP:55g | TCP:55g | | A-5:55g | | TCP:45g | | TCP:45g A-5:10g |
| | Ethyl acetate | 330g | 330g | 165g | 330g | 165g | 300g | 165g | 330g |
| | Alkanol B 10% aq. solution | 50ml | 50ml | 30ml | 50ml | 30ml | 50ml | 30ml | 50ml |
| | Gelatin 10% aq. solution | 700ml | 700ml | 400ml | 700ml | 400ml | 700ml | 400ml | 700ml |
| Disposition Composition (II) | High boiling-point organic solvent | | | TCP:55g | | A-5:55g | A-5:10g | TCP:45g A-5:10g | |
| | Ethyl acetate | | | 165g | | 165g | 30g | 165g | |
| | Alkanol B 10% aq. solution | | | 30ml | | 30ml | 6ml | 30ml | |
| | Gelatin 10% aq. solution | | | 400ml | | 400ml | 80ml | 400ml | |

Using each of dispersions (samples 3, 5, 6 and 7 were individually prepared by mixing dispersion compositions (I) and (II) together) shown in Table 3, samples individually having a stable silver halide color photographic emulsion layer formed on a support thereof were prepared in the same manner as in Example 1 but by varying the mode of incorporation into said emulsion layer of the coupler in combination with the high boiling-point organic solvent used. Each of the samples thus prepared was processed in the same procedure as in Example 1 to obtain a sample of magenta color developed image, which was then measured in speed as well as in maximum density. The results obtained were as shown in Table 4.

Table 4

| Sample No. | Bleaching Solution-(1) Relative Speed | Dmax | Bleaching solution-(2) Relative Speed | Dmax |
|---|---|---|---|---|
| 1 | 100 | 1.84 | 101 | 1.85 |
| 2 | 115 | 2.15 | 49 | 0.69 |
| 3 | 85 | 1.98 | 40 | 0.65 |
| 4 | 170 | 2.25 | 171 | 2.27 |
| 5 | 167 | 2.20 | 165 | 2.15 |
| 6 | 169 | 2.22 | 170 | 2.17 |
| 7 | 168 | 2.20 | 166 | 2.16 |
| 8 | 170 | 2.24 | 171 | 2.24 |

As is clear from the results of samples 2–3 in Table 4, in the case where TCP is used as a high boiling-point organic solvent, even when TCP is incorporated into the dispersion composition (II) containing no coupler and said dispersion composition is then mixed with the dispersion (I) containing a coupler, no improvement in processing stability is made and, on the contrary, the speed decreases. In contrast thereto, when amide compound A-5 used as a high boiling-point organic solvent is mixed with a coupler to prepare a single dispersion composition which is then used, as it is, as a coupler dispersion, an excellent efficiency similar to that of Example 1 is demonstrated. As is clear from the results of sample 5, even in the case where a coupler and an amide compound are individually incorporated into separate dispersion compositions and said dispersions are mixed together to prepare a coupler dispersion which is then incorporated into a silver halide emulsion, both the speed and maximum density attained thereby are high and the processing stability is also found excellent. As is clear from the results of samples 4–5, however, it is more preferable to incorporate simultaneously both the coupler and amide compound into a single dispersion composition which is then used, as it is, as a coupler dispersion. As can be clearly seen from the results of samples 6–8, even when a combination of TCP and amide compound A-5 is used as a high boiling-point organic solvent and the amount of amide compound A-5 is relatively reduced, both the speed and maximum density attained thereby are high and the processing stability is also found excellent. In that case, however, it is more preferable to incorporate simultaneously the coupler TCP and amide compound A-5 all together into a single dispersion composition, thereby giving better results.

EXAMPLE 4

There were used exemplified coupler B-21 as a magenta coupler; exemplified coupler M-1 which is a 4-equivalent coupler as a coupler for comparison purposes; exemplified DIR compounds D-3, D-8, D-16, D-19 and D-41 as DIR compounds; exemplified amide compound A-25 as a high boiling organic solvent; and dibutyl phthalate (hereinafter called "DBP") as a high boiling-point organic solvent for comparison purposes. Following the mode of combination as indicated in Table 5, dispersions were prepared by mixing all together each DIR compound in an amount of $5\times10^{-3}$ mole per mole of silver halide, each magenta coupler in an amount equal to that used in Example 1 and each high boiling-point organic solvent in an amount equal to the sum of amounts of said coupler and said DIR compound and then dispersing the resulting mixture in the same manner as in Example 1. Each of the dispersions thus prepared was use in the same manner as in Example 1 to prepare a sample having a stable silver halide color photographic emulsion layer formed on the support thereof. The sample thus prepared was exposed to light in the same procedure as in Example 1 and then subjected to the under-mentioned development processing step to obtain samples of two kinds of magentacolor developed images as shown in Table 5.

(Processing step) (37.8° C.)

1. Color development 3 minutes 15 seconds

After completion of the color development, each sample was divided into two portions, and one of the two divided portions was subjected to processing 2→3→4→5→6→7 in that order, and the other was subjected to processing 2'→5→6→7 in that order. In this case, however, the following processings 2, 3, 4, 5, 6 and 7 are all the same as in Example 1.

2. Bleaching 6 minutes 30 seconds
3. Water-washing 3 minutes 15 seconds
4. Fixing 6 minutes 30 seconds
2'. Bleach-fixing 10 minutes
5. Water-washing 3 minutes 15 seconds
6. Stabilizing 1 minutes 30 seconds
7. Drying The above-mentioned processing which involves the bleach-fixing step was to make a model case where the oxidizing ability is further weak as compared with the bleaching step of Example 1 using the bleaching solution -(2).

| Composition of bleach-fixing solution: | |
|---|---|
| Diammonium ethylenediamine tetraacetate | 7.5 g |
| Iron (III) ethylenediamine tetraacetate | 100.0 g |
| Sodium sulfite | 10.0 g |
| Sodium thiosulfate | 90.0 g |
| Thiourea | 10.0 g |

Water to make 1 liter and adjust to pH 6.2 with ammonium hydroxide.

The samples thus processed were individually measured in speed and maximum density to obtain the results as shown in Table 5.

Table 5

| Sample No. | Combination of Coupler, High boiling-point organic solvent and DIR compound | Bleaching solution-(1) Relative speed | Bleaching solution-(1) Dmax | Bleach-fixing solution Relative speed | Bleach-fixing solution Dmax |
|---|---|---|---|---|---|
| 1 | M-1+DBP | 100 | 1.70 | 100 | 1.70 |
| 2 | B-21+DBP | 121 | 1.82 | 50 | 0.84 |
| 3 | B-21+DBP+D-19 | 110 | 1.65 | 45 | 0.80 |
| 4 | B-21+A-25 | 172 | 2.15 | 150 | 1.87 |
| 5 | B-21+A-25+D-19 | 150 | 1.84 | 150 | 1.82 |
| 6 | B-21+A-25+D-3 | 162 | 1.88 | 160 | 1.87 |
| 7 | B-21+A-25+D-8 | 165 | 1.79 | 163 | 1.76 |
| 8 | B-21+A-25+D-16 | 158 | 1.75 | 152 | 1.74 |
| 9 | B-21+A-25+D-41 | 160 | 1.70 | 158 | 1.69 |

As is clear from the results of samples 1–3 in Table 5, in the case of the sample comprising a combination of the aldehydebis type magenta coupler B-21 of the present invention and DBP, the processing stability is poor, and even in the case of the sample comprising a combination of the present aldehydebis type magenta coupler B-21, DBP and DIR compound D-19, the processing stability is not improved. In contrast thereto, as is clear from the results of samples 4–9, when present magenta coupler B-21 is used in combination with the amide compound A-25 of the present invention as a high boiling-point organic solvent, the processing stability is improved. In the case where the bleach-fixing step is employed in the processing step, however, it is understood that the processing stability is further improved by the use of the DIR compound in the combination of coupler B-25 and amide compound A-25, thereby giving more preferable results.

EXAMPLE 5

On a trasparent cellulose triacetate film support were formed successively, from the support side, the undermentioned layers to prepare light-sensitive multi-coated color negative materials (multicoated samples 1–5).

First layer: Antihalation layer

An aqueous gelatin solution containing black colloid silver was coated on the support surface in a proportion of 0.3 g/m$^2$ of silver (a dry film thickness: 3$\mu$).

Second layer: Intermediate layer

An aqueous gelatin solution was coated on the first layer (a dry film thickness: 1$\mu$).

Third layer: Low speed red-sensitive silver halide emulsion layer

A silver iodobromide emulsion containing, per mole of silver halide, 60 g of 1-hydroxy-N-[δ-(2,4-di-t-amylphenoxy)butyl]-2-naphthamide as cyan coupler, 4 g of 1-hydroxy-4-[4-(1-hydroxy-δ-acetamido-3,6-disulfo-2-naphthylazo)phenoxy]-N-[δ-(2,4-di-t-amylphenoxy)butyl]-2-naphthamide disodium salt as colored coupler, and 2.8 g of 2-(1-phenyl-5-tetrazolylthio)-4-octadecylsuccinimido-1-indanone as a DIR compound, was coated on the second layer in a proportion of 18 g/m$^2$ of silver (a dry film thickness: 4$\mu$). The above-mentioned emulsion was a silver iodobromide emulsion containing 4 mole% of silver iodide and was color sensitized by means of anhydrous 5,5'-dichloro-9-ethyl-3,3'-di-(3-sulfopropyl)-thiacarbocyanine hydroxide and anhydrous 9-ethyl-3,3'-di-(3-sulfopropyl)-4,5,4',5'-dibenzothiacarbocyanine hydroxide.

Fourth layer: Red-sensitive high speed silver halide emulsion layer

A silver iodobromide emulsion containing, per mole of silver halide, 15 g of 1-hydroxy-4-(isopropylcarbamoyl)-methoxy-N-dodecyl-2-naphthamide as a cyan coupler, 1.5 g of 1-hydroxy-4-[4-(1-hydroxy-δ-acetamido-3,6-disulfo-2-naphthylazo)phenoxy]-N-[δ-(2,4-di-t-amylphenoxy)butyl]-2-naphthamide disodium salt as a colored coupler, and 2.1 g of 2-(1-phenyl-5-tetrazolylthio)-4-octadecylsuccinimido-1-indanone, was coated on the third layer in a proportion of 10 g/m$^2$ of silver (a dry film thickness: 2$\mu$).

The above-metnioned emulsion was a silver iodobromide emulsion containing 7 mole% of silver iodide and was color sensitized with the same sensitizing dyes as in the third layer.

Fifth layer: Intermediate layer

The intermediate layer coated on the fourth layer was the same as the second layer.

| | |
|---|---|
| Sixth layer<br>Seventh layer | : Green-sensitive silver halide emulsion layers |

The sixth and seventh layers were individually an emulsion layer comprising a composition containing magenta couplers, DIR compounds, high boiling-point organic solvents, etc. as shown in Table 6. The emulsion used in the sixth layer was a low speed silver iodobromide emulsion containing 5 mole% of silver iodide and was coated on the fifth layer in a proportion of 14 g/m$^2$ of silver (a dry film thickness: 4$\mu$).

The emulsion used in the seventh layer was a high speed silver iodobromide emulsion containing 7 mole% of silver iodide and was a coated on the sixth layer in a proportion of 12 g/m$^2$ of silver (a dry film thickness: 1.8$\mu$). Both the emulsions used in the sixth and seventh layers were sensitized by means of anhydrous 5,5'-dichloro-9-ethyl-3,3'-di-t-(3-sulfopropyl)oxacarbocyanine hydroxide, anhydrous 5,5'-diphenyl-9-ethyl-3,3'-di-(3-sulfopropyl-)oxacarbocyanine hydroxide and anhydrous 9-ethyl-3,3'-di-(3-sulfopropyl) 5,6,5',6'-dibenzooxacarbocyanine hydroxide. The colored coupler used in the sixth layer as well as in the seventh layer was 1-(2,4,6-trichlorophenyl)-3-(2-chloro-5-octadecenylsuccinimidoanilino)-4-(4-hydroxyphenylazo)-5-pyrazolone.

In the sixth layer, a mixture of couplers, high boiling-point organic solvents and a DIR compound was dissolved in hot ethyl acetate, the resulting solution was then mixed with an aqueous Alkanol B solution and aqueous gelatin solution, and the resulting mixture was dispersed by means of a colloid mill to prepare a dispersion which was then incorporated into the silver halide emulsion. In the case of the seventh layer, a mixture of couplers and high boiling-point organic solvents was dissolved in hot ethyl acetate, the resulting solution was then mixed with an aqueous Alkanol B solution and an aqueous gelatin solution, and the resulting mixture was dispersed by means of a colloid mill to prepare a dispersion. Furthermore, the DIR compound was dissolved in hot ethyl acetate, the resulting solution was then mixed with an aqueous Alkanol B solution and an aqueous gelatin solution, and the resulting mixture was treated with a colloid mill to prepare a dispersion.

The coupler dispersion and the dispersion of the DIR compound were individually incorporated into the silver halide emulsion.

Eighth layer: Intermediate layer

The intermediate layer formed on the seventh layer was the same as the second layer.

Nineth layer: Yellow filter layer

An aqueous gelatin solution containing yellow colloid silver and 2,5-di-t-octylhydroquinone was coated on the eighth layer in a proportion of 0.1 g/m$^2$.

Tenth layer: Blue-sensitive low speed silver halide emulsion layer

A silver iodobromide emulsion containing, per mole of silver halide, 200 g of α-(1-benzyl-2-phenyl-3,5-dioxo-1,2,4-triazolidinyl)]-α-pivalyl-2-chloro-5-(δ-(2,4-di-t-amylphenoxy)-butylamido]acetanilide as yellow coupler was coated on the nineth layer in a proportion of 5 g/m$^2$ of silver (a dry film thickness: 4μ). This emulsion was a silver iodobromide emulsion containing 8 mole% of silver iodide and color sensitized with anhydrous 3,3'-di-(3-sulfopropyl)-selenacyanine hydroxide.

Eleventh layer: Blue sensitive high speed silver halide emulsion layer

A silver iodobromide emulsion containing, per mole of silver halide, 130 g of the same coupler as in the tenth layer as a yellow coupler was coated on the tenth layer in a proportion of 7 g/m$^2$ of silver (a dry film thickness: 3μ). This emulsion was a silver iodobromide emulsion containing 7 mole% of silver iodide and color sensitized with the same sensitizing dye as in the tenth layer.

Twelveth layer: Intermediate layer

The intermediate layer formed on the eleventh layer was the same as the second layer.

Thirteenth layer: Protective layer

An aqueous gelatin solution containing bis-[α,α,ω-trihydroperfluoropeptyl]-sodiumsulfosuccinate was coated on the twelveth layer. The high speed multi-coated color negative light-sensitive silver halide materials (multi-coated samples 1–5) prepared in the above manner were individually subjected to wedge exposure through a green filter and the subjected to processing in the same manner as in Example 1.

The samples thus subjected to processing were individually subjected to sensitometry with green light to obtain the results as shown in Table 7, in which the relative speed was represented as a relative value determined by assuming as 100 being the speed of the multi-coated sample-1 treated with the bleaching solution -(1).

Table 7

| | Bleaching Solution - 1 | | | | Bleaching Solution - 2 | | | |
|---|---|---|---|---|---|---|---|---|
| Sample No. | Minimum Density | Relative Speed | Gamma | Dmax | Minimum Density | Relative Speed | Gamma | Dmax |
| 1 | 0.45 | 100 | 0.67 | 2.14 | 0.44 | 99 | 0.66 | 2.10 |
| 2 | 0.46 | 132 | 0.69 | 2.20 | 0.45 | 52 | 0.39 | 0.99 |
| 3 | 0.47 | 174 | 0.68 | 2.23 | 0.47 | 172 | 0.66 | 2.14 |
| 4 | 0.46 | 180 | 0.68 | 2.21 | 0.46 | 180 | 0.68 | 2.21 |
| 5 | 0.45 | 178 | 0.66 | 2.13 | 0.45 | 178 | 0.66 | 2.15 |

As is clear from Table 7, it is understood that by using the aldehydebis type magenta coupler and amide compound of the present invention in the green-sensitive silver halide layers of a multi-coated color negative light-sensitive silver halide material, markedly high speed can be obtained, as compared with the case of prior art multi-coated samples-1 and -2, and at the same time an excellent processing stability is imparted to the samples according to the present invention.

Further, Table 7 clearly indicates that the combination use of the DIR compound in the green-sensitive silver halide emulsion layers results in further improvement of processing stability.

EXAMPLE 6

On a transparent polyethylene terephthalate film support were formed successively from the support side the under-mentioned layers to prepare high speed multi-coated color reversal materials (multi-coated samples 6–8).

First layer: An antihalation layer containing black colloid silver.

Second layer: A gelatinous intermediate layer.

Third layer: Red-sensitive silver halide emulsion layer.

A silver iodobromide emulsion containing, per mole of silver halide, 50 g of 1-hydroxy-N-[δ-(2,4-di-t-amylphenoxy)butyl]-2-naphthamide as a cyan coupler was coated on the second layer in a proportion of 15 g/m$^2$ of silver. This emulsion is a silver iodobromide emulsion containing 6 mole% of silver iodide and was sensitized with sensitizing dye so as to become sensitive to red light.

Fourth layer: A gelatinous intermediate layer.

An emulsion containing a substantially nonsensitive silver iodobromide (containing 4 mole% of silver iodide) was coated on the third layer in a proportion of 4 g/m$^2$ of silver.

Fifth layer: Green-sensitive silver halide emulsion layer.

The fifth layer is a silver iodobromide emulsion (containing 6 mole% of silver iodide) comprising a combination of a coupler and a high boiling-point organic solvent as shown in Table 8 and each emulsion was coated on the fourth layer in a proportion of 17 g/m$^2$ of silver. This emulsion was sensitized with anhydrous 5,5'-di-phenyl-9-ethyl-3,3'-di-(3-sulfopropyl) oxacarbocyanine hydroxide and anhydrous 5,5',6,6'-tetrachloro-1,1'-di-ethyl-3,3'-di-(3-sulfopropyl)imidacarbocyanine hydroxide so as to become sensitive to green light.

Table 8

| Examplified Compound | Sample No. 6 | Sample No. 7 | Sample No. 8 |
|---|---|---|---|
| B - 11 | 68 g | 68 g | 54 g |
| M - 3 | — | — | 14 g |
| A - 3 | — | 140 g | 40 g |
| DBP | 140 g | — | 100 g |

The coupler and the high boiling-point organic solvent were dissolved in hot ethyl acetate, the resulting solution was then mixed with an aqueous Alkanol B solution and an aqueous gelatin solution, and the resulting mixture was dispersed by means of a colloid mill to prepare a dispersion which was then incorporated into the silver halide emulsion.

Sixth layer: A yellow filter layer containing yellow colloid silver.

Seventh layer: Blue-sensitive silver halide emulsion layer.

A silver iodobromide emulsion containing, per mole of silver halide, 250 g of α-(4-nitrophenoxy)-α-pivalyl-5-[δ-(2,4-di-t-amynophenoxy)-butylamido]-2-chloroacetanilide as a yellow coupler was coated on the sixth layer in a proportion of 10 g/m$^2$ of silver. This emulsion was a silver iodobromide emulsion containing 6 mole% of silver iodide and was sensitized with a sensitizing dye so as to become sensitive to blue light.

Eighth layer: A protective gelatinous layer.

The thus prepared high speed light-sensitive multi-coated color reversal materials were individually subjected to wedge exposure through a green filter and then subjected to processing according to the undermentioned processing step.

At the stage of completion of water-washing of the second time during the processing step, each sample was divided into three portions, the thus divided three portions were processed with the bleaching solutions -(3), -(4) and -(5), respectively, and were subjected all together after water-washing to fixing and processing subsequent thereto under the same conditions as will be mentioned below, provided that the sample processed with the bleaching solution -(4) was processed with a neutralizing solution containing sodium citrate and then subjected the subsequent processing.

| [Processing step] (37.8° C.) | Processing time |
|---|---|
| First development | 3 minutes |
| First stopping | 1 minute 30 seconds |
| Water-washing | 1 minute 30 seconds |

-continued

| [Processing step] (37.8° C.) | Processing time |
|---|---|
| Color development | 6 minutes |
| Second stopping | 1 minute 30 seconds |
| Water-washing | 3 minutes |
| Bleaching | 6 minutes |
| Water-washing | 3 minutes |
| Fixing | 6 minutes |
| Water-washing | 3 minutes |
| Water drop prevention | 1 minute 30 seconds |
| Drying | |

The processing solutions used in the above processing step were those having their respective components as mentioned below.

| First developer: | |
|---|---|
| Sodium hexametaphosphate | 1.5 g |
| Sodium bisulfite (anhydrous) | 8.0 g |
| Phenidon (a trade name of Ilford Co.) | 0.3 g |
| Sodium sulfite (anhydrous) | 37 g |
| Hydroquinone | 5.0 g |
| Sodium carbonate (anhydrous) | 28.0 g |
| Sodium thiocyanide | 1.4 g |
| Sodium bromide (anhydrous) | 1.4 g |
| Potassium iodide (0.1% aq. solution) | 10.0 ml |
| Water to make | 1 liter |

| First and second stopping solutions: | |
|---|---|
| Glacial acetic acid | 3.0 ml |
| Sodium hydroxide | 1.7 g |
| Water to make | 1 liter |

| Color developer: | |
|---|---|
| Sodium hexametaphosphate | 2 g |
| Benzyl alcohol | 5 ml |
| Sodium sulfite (anhydrous) | 3 g |
| Trisodium phosphate (12$H_2O$) | 35 g |
| Sodium bromide (anhydrous) | 0.8 g |
| Potassium iodide (0.1% aq. solution) | 75 ml |
| Sodium hydroxide | 32 g |
| Citradic acid | 2 g |
| 4-Amino-N-ethyl-N-(β-methanesulfonamidoethyl)-m-toluidinesesquisulphate monohydrate | 10 g |
| Ethylenediamine | 1.7 g |
| tert-Butyl aminoboran | 0.9 g |
| Water to make | 1 liter |

| Bleaching solution - (3): | |
|---|---|
| Potassium nitrate | 25 g |
| Potassium ferricyanide | 20 g |
| Boric acid | 5 g |
| Borax (10 $H_2O$) | 1 g |
| Water to make | 1 liter |

| Bleaching solution - (4): | |
|---|---|
| Ferric chloride (hexahydrate) | 233 g |
| Water to make | 1 liter |

| Bleaching solution - (5): | |
|---|---|
| Diammonium ethylenediamine tetraacetate | 10 g |
| Iron (III) ethylenediamine tetraacetate | 150 g |
| Ammonium bromide | 80 g |
| Ammonia water (28%) | 40 ml |
| Water to make | 1 liter |

(Adjusted to pH 6.0 with acetic acid)

| Fixing solution: | |
|---|---|
| Ammonium thiosulfate | 120 g |
| Potassium isomeric bisulfite | 20 g |
| Water to make | 1 liter |

| Water drop preventing solution: | |
|---|---|
| Konidax (produced by Konishiroku Photo Industry Co., Ltd.) | 10 ml |
| Water to make | 1 liter |

Subsequently, magenta color developed images respectively formed on the samples thus subjected to processings were measured in maximum density.

Further, these samples were tested for light fastness in the same manner as in Example 1.

The results obtained were as shown in Table 9.

The light fastness was represented by percentage of a density of the image as measured after irradiation treatment with light to the maximum density of said image as measured before the treatment.

Table 9

| Sample No. | Color developability | | | Fading of color dye image | | |
|---|---|---|---|---|---|---|
| | Bleaching solution - 3 | Bleaching solution - 4 | Bleaching solution - 5 | Bleaching solution - 3 | Bleaching solution - 4 | Bleaching solution - 5 |
| 6 | 3.12 | 2.80 | 1.65 | 52% | 45% | 27% |
| 7 | 3.24 | 3.23 | 3.24 | 73% | 72% | 74% |
| 8 | 3.20 | 3.21 | 3.21 | 78% | 79% | 78% |

As is clear from Table 9, it is understood that by using the aldehydebis type coupler and the amide compound according to the present invention in the green-sensitive silver halide emulsion layer of light-sensitive multicoated color reversal material, samples No. 7 and 8 are provided with stable color developability and excellent light fastness as compared with the prior art multicoated sample No. 6 and thus the light-sensitive color photographic materials according to the present invention have prominent characteristics even when treated under widely varying bleaching conditions.

What is claimed is:

1. A silver halide photosensitive material comprising a support and a silver halide emulsion layer which layer comprises an aldehydebis type magenta coupler represented by the formula

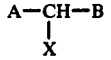

wherein A and B individually represent a 5-pyrazolone coupler residue or a pyrazolino-(1,5-a)-benzimidazole coupler residue, and X represents hydrogen, an alkyl group, an alkenyl group, an aralkyl group, a cycloalkyl group, a cycloalkenyl group, an aryl group or a 5- or 6-membered heterocyclic or condensed heterocyclic ring containing at least one member selected from nitrogen, oxygen or sulfur, and an amide compound represented by the formula

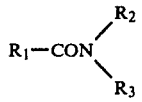

wherein $R_1$, $R_2$ and $R_3$ individually represent hydrogen, an aliphatic hydrocarbon residue, phenyl or $\alpha$- or $\beta$-naphthyl which may have at least one substituent selected from alkyl having 1–15 carbon atoms, halogen, alkoxy, having 1–15 carbon atoms, amino which may be substituted with one or more alkyl groups, provided that at least one of the $R_1$, $R_2$ and $R_3$ represents the residue or group containing not less than 6 carbon atoms, and $R_1$ and $R_2$ or $R_2$ and $R_3$ can cooperatively form a 5- to 7-membered heterocyclic ring.

2. A silver halide photosensitive material according to claim 1 wherein the aliphatic hydrocarbon residue is an alkyl group, an alkenyl group, or an alkynyl group.

3. A silver halide photosensitive material according to claim 1 wherein X represents hydrogen.

4. The silver halide photosensitive material according to claim 1 wherein A and B individually represent by the following general formula (III) and (IV);

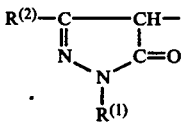

Formula (III)

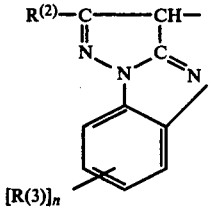

Formula (IV)

wherein $R^{(1)}$ represents hydrogen, an alkyl group, an alkenyl group, a cycloalkyl group, a cycloalkenyl group, an aryl group, a 5- or 6-membered heterocyclic or condensed heterocyclic ring containing at least one member selected from nitrogen, oxygen, and sulfur, an acyl group, a thioacyl group, an alkylsulfonyl group, an arylsulfonyl group, an alkylsulfinyl group, an arylsulfinyl group, a carbamoyl group or a thiocarbamoyl group; $R^{(2)}$ represents an alkyl group, an alkenyl group, a cycloalkyl group, an aralkyl group, a cycloalkyl group, an aryl group, an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, an ureido group, an urethane group, a thiourethane group, an anilino group, an alkylamino group, a cycloamino group, a sulfonamide group, a carbamoyl group, a sulfomoyl group, a guanidino group, a cyano group, an acyloxy group, a sulfonyloxy group, hydroxy, mercapto, halogen or sulfo; $R^{(3)}$ represents hydrogen, halogen, cyano, carboxy, hydroxy, sulfo, mercapto, an alkyl group, an alkenyl group, a cycloalkyl group, a cycloalkenyl group, an aryl group, an alkoxy group, an aryloxy group, an alkoxycarbonyl group, an acyloxy group, an alkylcarbonyl group, an arylcarbonyl group, an alkylthiocarbonyl group, an arylthiocarbonyl group, a sulfamoyl group, a carbamoyl group, an acylamino group, a diacylamino group, an imido group, an ureido group, a thioureido group, an urethane group, a thiourethane group, a sulfonamido group, an alkylsulfonyloxy group, an arylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-arylanilino group, an N-alkylanilino group or an N-acylanilino group; and n represents an integer of 1–4.

5. A silver halide photosensitive material according to claim 4 wherein $R^{(1)}$ represents phenyl substituted, at least one of ortho-positions, with alkyl, alkoxy or halogen.

6. A silver halide photosensitive material according to claim 5 wherein $R^{(1)}$ represents phenyl substituted with alkyl, alkoxy and/or halogen at the 2-, 4- and 6-positions of the phenyl.

7. A silver halide photosensitive material according to claim 5 wherein $R^{(1)}$ represents phenyl substituted with alkyl, alkoxy and/or halogen at the 2-, 3-, 4-, 5- and 6-position of the phenyl.

8. A silver halide photosensitive material according to claim 4 wherein A and B are individually represented by the following general formula [III-a] or [III-b];

Formula (III-a)

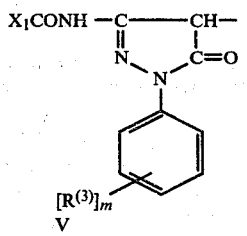

V

Formula (III-b)

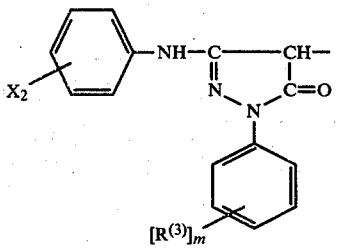

wherein V represents halogen, cyano, nitro, trifluoromethyl, an alkoxy group, an aryloxy group, an alkylthio group, an arylthio group, an amido group or an imido group; $X_1$ represents an alkyl group, an aryl group, an arylamino group or an alkylamino group; $X_2$ represents hydrogen, halogen, an alkyl group, an alkoxy group, an aryloxy group, an acylamino group, a sulfamoyl group, a sulfonamido group, an imido group or an alkoxycarbonyl group; and m represents an integer of 1–5; provided that $X_2$ is attached to the m- or p-position of the phenyl.

9. The silver halide photosensitive material according to claim 1 wherein the coupler is represented by the following general formula (V):

Formula [V]

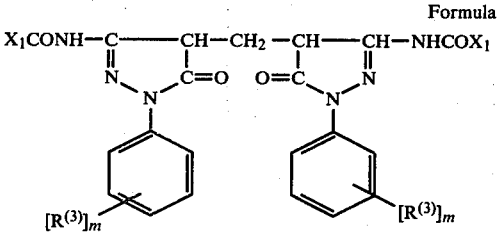

wherein $R^{(3)}$ represents hydrogen, halogen, cyano, carboxy, hydroxy, sulfo, mercapto, an alkyl group, an alkenyl group, a cycloalkyl group, a cycloalkenyl group, an aryl group, an alkoxy group, an aryloxy group, an alkoxycarbonyl group, an acyloxy group, an alkylcarbonyl group, an arylcarbonyl group, an alkylthiocarbonyl group, an arylthiocarbonyl group, a sulfamoyl group, a carbamoyl group, an acylamino group, a diacylamino group, an imido group, an ureido group, a thioureido group, an urethane group, a thiourethane group, a sulfonamido group, an alkylsulfonyloxy group, an arylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-arylanilino group, an N-alkylanilino group or an N-acylanilino group; and n represents an integer of 1–4, $X_1$ represents an alkyl group, an aryl group, an arylamino group or an alkylamino group, and m represents an integer of 1 to 5.

10. The silver halide photosensitive material according to claim 1 further comprising a compound which releases a development inhibiting type compound on reaction with an oxidation product of an aromatic primary amine developing agent, and is represented by the following general formula (VI), (VII), (VIII), (IX), (X) or (XI);

Formula [VI]

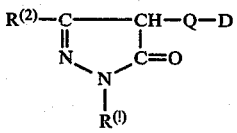

Formula [VII]

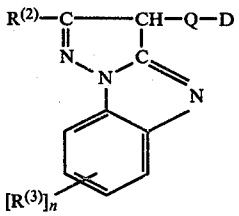

Formula [VIII]

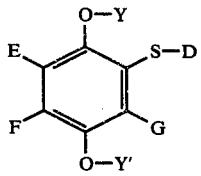

-continued

Formula [IX]

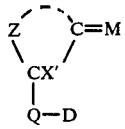

Formula [X]

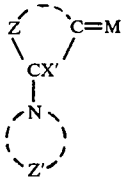

Formula [XI]

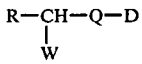

wherein $R^{(1)}$ represents hydrogen, an alkyl group, an alkenyl group, a cycloalkyl group, a cycloalkenyl group, an aryl group, a 5- or 6-membered heterocyclic or condensed heterocyclic ring containing at least one member selected from oxygen, nitrogen, and sulfur, an acyl group, a thioacyl group, an alkylsulfonyl group, an arylsulfonyl group, an alkylsulfinyl group, an arylsulfinyl group, a carbamoyl group or a thiocarbamoyl group; $R^{(2)}$ represents an alkyl group, an alkenyl group, a cycloalkyl group, an aralkyl group, a cycloalkyl group, an aryl group, a nitrogen containing 5- to 7-membered heterocyclic ring, an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, an ureido group, an urethane group, a thiourethane group, an anilino group, an alkylamino group, a cycloamino group, a sulfonamido group, a carbamoyl group, a sulfamoyl group, a guanidino group, a cyano group, an acyloxy group, a sulfonyloxy group, hydroxy, mercapto, halogen or sulfo; $R^{(3)}$ represents hydrogen, halogen, cyano, carboxy, hydroxy, sulfo, mercapto, an alkyl group, an alkenyl group, a cycloalkyl group, a cycloalkenyl group, an aryl group, an alkoxy group, an aryloxy group, an alkoxycarbonyl group, an acyloxy group, an alkylcarbonyl group, an arylcarbonyl group, an alkylthiocarbonyl group, an arylthiocarbonyl group, a sulfamoyl group, a carbamoyl group, an acylamino group, a diacylamino group, an imido group, an ureido group, a thioureido group, an urethane group, a thiourethane group, a sulfonamido group, an alkylsulfonyloxy group, an arylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-arylanilino group, an N-alkylanilino group or an N-acylanilino group; n represents an integer of 1–4; Q represents sulfur or selenium; D represents a group which forms, together with sulfur or selenium, a compound having development inhibiting action, when sulfur or selenium of thioether or selenoether bond is liberated; E, F and G individually represent hydrogen, halogen, hydroxy, an alkyl group, an alkoxy group, an amino group, an alkylthio group, tetrazolyl, oxazolyl, imidazolyl, thiazolyl, quinolinyl or —S—D; Y and Y' individually represent hydrogen, or a group capable of releasing under alkali conditions; X' represents hydrogen or halogen; Z represents a nonmetal atomic group necessary for forming a hydrocarbon ring or a 5- to 7-membered heterocyclic ring containing at least one member selected from nitrogen, oxygen and sulfur; Z' represents an atomic group necessary for forming together with nitrogen a heterocyclic ring having development inhibiting action, when C-N bond is cleaved; M represents oxygen or =N-L, in which L represents hydroxy or an amino group; R represents

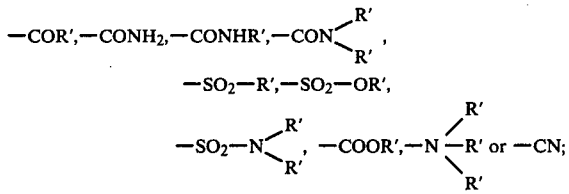

R' represents an alkyl group, an alkenyl group, an aryl group or a 5- to 6-membered heterocyclic ring having at least one member selected from oxygen, nitrogen, and sulfur; and W represents hydrogen, halogen, an alkyl group, an aryl group, a 5- to 6-membered heterocyclic ring, an alkoxy group, a heteroaryloxy group, an acyloxy group or —Q—D.

11. A silver halide photosensitive material according to claim 10 wherein —Q—D represents a mercaptotetrazole group, a mercaptothiazole group, a mercaptodiazole group, a mercaptotriazine group, a mercaptothiaziazole group, a mercaptooxazole group, an arylmercapto group, a heterocyclic seleno group or an arylseleno group.

12. A silver halide photosensitive material according to claim 10 wherein $R^{(1)}$ represents phenyl substituted with halogen, lower alkyl and/or lower alkoxy.

13. A silver halide photosensitive material according to claim 10 wherein the compound which releases a development inhibiting type compound on reaction with an oxidation product of an aromatic primary amine developing agent, is represented by formula [VIII], [IX], [X] or [XI].

14. A silver halide photosensitive material according to claim 13 wherein the compound which releases a development inhibiting type compound on reaction with an oxidation product of an aromatic primary amine developing agent, is represented by formula [IX], [X] or [XI].

* * * * *